US010988990B2

(12) United States Patent
Ford

(10) Patent No.: US 10,988,990 B2
(45) Date of Patent: Apr. 27, 2021

(54) ROD CENTRALIZER AND SOLIDS CONTROL ASSEMBLY

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days.

(21) Appl. No.: 16/848,428

(22) Filed: Apr. 14, 2020

(65) Prior Publication Data

US 2020/0347681 A1 Nov. 5, 2020

Related U.S. Application Data

(60) Provisional application No. 62/842,891, filed on May 3, 2019.

(51) Int. Cl.
*E21B 17/10* (2006.01)

(52) U.S. Cl.
CPC ..... *E21B 17/1014* (2013.01); *E21B 17/1071* (2013.01)

(58) Field of Classification Search
CPC .. E21B 17/1014; E21B 17/1071; E21B 37/02; E21B 37/04; E21B 37/045
See application file for complete search history.

(56) References Cited

U.S. PATENT DOCUMENTS 1,342,618 A 6/1920 Bashara
2,362,198 A * 11/1944 Gibson ..... E21B 37/02 166/173
3,364,998 A 1/1968 Sable
5,452,760 A 9/1995 Bertagnolli
5,570,742 A 11/1996 Reynolds
7,210,529 B2 5/2007 Ruttley
9,163,483 B2 10/2015 Ford
2001/0022223 A1* 9/2001 Howlett ..... E21B 17/02 166/173

(Continued)

OTHER PUBLICATIONS

For the American Heritage Dictionary definition: aperture. (n.d.) The American Heritage(R) Dictionary of the English Language, Fourth Edition. (2003). Retrieved Jun. 27, 2014 from http://www.thefreedictionary.com/aperture.

(Continued)

*Primary Examiner* — David Carroll
(74) *Attorney, Agent, or Firm* — Weiss & Moy, P.C.; Karen J. S. Fouts

(57) ABSTRACT

A rod centralizer and solids control assembly can be mounted on a rod string. The assembly allows well fluid containing high solids to pass through the pump while eliminating the solids from being swept back into the pump barrel or accumulating in the tubing. The assembly can include a body portion coupled to a bristle positioned helically around the body portion. The bristle can be coupled to a piston, allowing the bristle to extend during upward fluid movement and retract when rod rotation stops. The bristle can trap solids, leaving the solids higher and away from a pump intake. This can allow the solids to be lifted out of the pump, preventing solids from collecting on a bottom portion of the pump or tubing. The assembly can include centralizer components that center the rod, preventing it from rubbing against the tubing. Multiple assemblies can be incorporated into the rod string.

19 Claims, 19 Drawing Sheets

(56) References Cited

U.S. PATENT DOCUMENTS

| | | | | |
|---|---|---|---|---|
| 2002/0005284 | A1* | 1/2002 | Allen | E21B 37/02 166/173 |
| 2004/0011532 | A1* | 1/2004 | White | E21B 17/1071 166/381 |
| 2011/0114338 | A1* | 5/2011 | Casassa | E21B 17/1078 166/382 |
| 2013/0140032 | A1* | 6/2013 | Ford | E21B 17/1071 166/311 |

OTHER PUBLICATIONS

For the American Heritage Dictionary definition: bristle. (n.d.) The American Heritage(R) Dictionary of the English Language, Fourth Edition. (2003). Retrieved Jul. 2, 2014 from http://www.thefreedictionary.com/bristle.

For the American Heritage Dictionary definition: along. (n.d.) The American Heritage(R) Dictionary of the English Language, Fourth Edition. (2003). Retrieved Nov. 3, 2014 from http://www.thefreedictionary.com/along.

* cited by examiner

ROD CENTRALIZER AND SOLIDS CONTROL ASSEMBLY

CROSS-REFERENCE TO RELATED APPLICATIONS

This non-provisional application claims priority to U.S. Provisional Application Ser. No. 62/842,891 entitled ROD CENTRALIZER AND SOLIDS CONTROL ASSEMBLY that was filed on May 3, 2019 in the name of the inventor of this non-provisional application and which is hereby incorporated herein by reference. The present application is also related to U.S. Pat. No. 9,163,483, entitled "Rod Guide and Solids Control Assembly," which was issued on Oct. 20, 2015 in the name of the inventor herein, which is incorporated herein by reference.

TECHNICAL FIELD

The present disclosure generally relates to fluid pumping apparatuses and, more particularly, to a rod centralizer and solids control assembly that holds solids within the fluid when rod rotation stops and leaves the solids behind when rod rotation or upward fluid movement occurs, keeping solids away from the pump.

BACKGROUND

Oil well pumping systems are well known in the art. Such systems can be used to mechanically remove oil or other fluid from beneath the earth's surface, particularly when the natural pressure in an oil well has diminished. Various configurations of pumping systems have been developed in the past. One such configuration is the conventional rod pump. Generally, in the conventional rod pump configuration, an oil well pumping system can begin with an above-ground pumping unit, which can be commonly referred to as a "pumpjack." The pumping unit in the conventional rod pump configuration can create a reciprocating up and down pumping action that moves the oil or other substance being pumped out of the ground and into a flow line, from which the oil can then be taken to a storage tank or other such structure.

In the conventional rod pump configuration, below the ground, a shaft can be lined with piping known as "tubing." Into the tubing is inserted a string of sucker rods, which ultimately can be indirectly coupled at its north end to the above-ground pumping unit. The string of sucker rods can be indirectly coupled at its south end to a subsurface pump that is located at or near the fluid in the oil well. The subsurface pump can have a number of basic components, including a barrel and a plunger. The plunger can operate within the barrel, and the barrel, in turn, can be positioned within the tubing. It is common for the barrel to include a standing valve and the plunger to include a traveling valve. The north end of the plunger can be typically connected to a valve rod, which moves up and down to actuate the pump plunger. The valve rod can pass through a guide positioned at the north end of the barrel, which assists in centering the valve rod and thereby, the plunger. In addition, the guide can include openings through which the oil or other substance being pumped can exit the pump barrel and travel into the tubing.

An example of another known pumping system configuration is the conventional rotational rod pump. Such conventional rotational rod pumps can include, for example, the progressive cavity pump ("PCP"). Generally, with the conventional rotational rod pump configuration, a pumping system can begin with an above-ground pumping unit, which can be commonly referred to as a "power gear assembly," a "power head," and the like. The above-ground pumping unit in the conventional rotational rod pump configuration can create a rotational pumping action that rotates a string of rods, thereby moving the oil or other substance being pumped out of the ground and into a flow line, from which the oil can then be taken to a storage tank or other such structure. In contrast to the conventional rod pump configuration, with the conventional rotational rod pump configuration, the rods rotate, but are stationary as to vertical movement. One advantage to using the conventional rotational rod pump configuration (such as the PCP) is that it can be designed to handle downhole production recovery in well conditions in which high amounts of solids and/or high percentages of water are present.

As with the conventional rod pump configuration, in the conventional rotational rod pump configuration, below the ground, a shaft can be lined with piping known as "tubing." In the conventional rotational rod pump configuration, into the tubing is inserted a string of rotational drive rods, which ultimately can be indirectly coupled at its north end to the above-ground pumping unit. The string of rotational drive rods can be indirectly coupled at its south end to a subsurface pump that is located at or near the fluid in the oil well. In the conventional rotational rod pump configuration, the subsurface pump can utilize a helical design and can have a number of basic components, including a rotor and a stator. The rotor can be encased within and can operate within the stator, and the stator, in turn, can be positioned within the tubing. The north end of the rotor can be typically connected to the string of rotating rods, which rotate to actuate the pump rotor. The string of rotating rods can typically rotate in a clockwise direction at a set speed, which may include various speeds ranging from approximately 50 to 400 rpm, depending upon the viscosity of the fluid to be pumped. Higher viscosity fluids may be pumped at relatively slower speeds and lower viscosity fluids may be pumped at relatively higher speeds. The string of rotating rods can pass through a centralizer positioned at the north end of the stator, which assists in centering the rotating rods and, thereby, the rotor. In addition, the centralizer can include openings through which the oil or other substance being pumped can exit the pump stator and travel into the tubing.

There are a number of problems that can occur during oil pumping operations. Fluid that is pumped from the ground is generally impure, and includes solid impurities such as sand, pebbles, limestone, and other sediment and debris. Certain kinds of pumped fluids, such as heavy crude, tend to contain a relatively large amount of solids. Because of this, several disadvantages exist with both prior pump configurations utilizing valve rods and with prior pump configurations utilizing rotating rods.

For example, with respect to prior pump configurations utilizing valve rods, after the solids have been exhausted from the pump barrel and the pump has temporarily discontinued pumping operations, the solids can naturally begin to settle due to gravity. With prior art valve rods, the solids are able to reenter the pump barrel at this time. The solids can further settle on top of the pump section, filling upward into the tubing. This often results in excessive barrel wear upon restarting of the pump. Furthermore, it is possible that with the solids reentering the pump barrel, they can cause sticking of the pump i.e., seizing the plunger in the barrel.

Conventional pumps discharge fluid into the tubing allowing the fluid to move to the surface. On upstrokes, the well fluid through the pump can discharge to the top valve rod guide. When the plunger moves downward back into the barrel, the open cage atop the pump can allow fluid that was just discharged to reenter the barrel through the rod guide. The fluid discharged into the tubing from the pump can contain solids that concentrate themselves into the first two or three joints of tubing due to gravity. The fluid contained in this section of tubing can be concentrated and contain a higher percentage of solids than the fluid that was just discharged thus introducing additional solid impurities that create additional damage to both the barrel and plunger. Furthermore, the string of sucker rods reciprocating in an up and down movement can cause the rod to rub on the tubing typically made of steel. This can cause failure of the tubing resulting in leaking of fluid and thereby preventing fluid from reaching the surface.

With respect to prior pump configurations utilizing rotating rods, several disadvantages exist as well. For example, after the solids have been exhausted from the pump stator and the pump has temporarily discontinued pumping operations, the solids can naturally begin to settle due to gravity. With prior art rotating rods, the solids are able to reenter the pump stator and accumulate in the tubing at this time. The solids can further settle on top of the pump section, filling upward into the tubing. This often results in excessive stator and rotor wear upon restarting of the pump, or prohibiting pump startup due to accumulated solids in the tubing. Furthermore, it is possible that with the solids reentering the pump stator, they can cause sticking of the pump i.e., seizing the rotor in the stator.

Conventional rotational rod pumps discharge fluid into the tubing, allowing the fluid to move to the surface. On startup, the well fluid moving through the pump can discharge to the top rotating rod. When the rotor moves in the stator, the pump can allow fluid that was just discharged to reenter the stator through the rod centralizer. The fluid discharged into the tubing from the pump can contain solids that concentrate themselves into the first two or three joints of tubing due to gravity. The fluid contained in this section of tubing can be concentrated and contain a higher percentage of solids than the fluid that was just discharged thus introducing additional solid impurities that create additional damage to both the stator and rotor. Furthermore, the rotational movement of the string of rotating rods can cause the rods to rub on the tubing typically made of steel. This can cause failure of the tubing resulting in leaking of fluid and thereby preventing fluid from reaching the surface.

Other concerns with conventional rotational rod pump configurations include, for example, that the power supply can be occasionally interrupted or an over-torque situation can occur due to the presence of high amounts of solids. When this occurs, the pumped fluid containing the high amounts of solids stops moving upwardly through the tubing, which then allows the solids to settle back downward toward the pump. The solids can accumulate upwardly into the tubing, causing the tubing and tubing joints to become filled with solids. This can cause the rotational drive rods to seize, thereby prohibiting the pump from restarting once the power supply is restored or the over-torque situation is remedied.

Further, seizure of the rotational drive rods can also be caused due to the orientation of rod guides, which typically are permanently affixed to the rotational drive rods, with typically two to four rod guides being equally spaced on a rod. When the solids fall in and around the rod guides or the rod centralizer, the solids can anchor the affixed rod guides to the tubing wall due to the sheer volume of the solids, preventing the rotational drive rods from rotating upon restarting the pump. This causes an over-torque situation where the well will be shut down, with the operators eventually being required to pull both the rotational drive rods and the tubing from the well collectively, since the rotational drive rods and tubing are cemented together with solids.

Further still, with conventional rotational rod pump configurations, solids can settle in various areas within the pump assembly, including in the multiple cavities between the rotor and stator and on and around the area of each lobe. This, too, can cause sticking of the pump components.

A solution to the above-mentioned problems concerning prior pump configurations utilizing valve rods was disclosed in U.S. Pat. No. 9,163,483, which was issued to the inventor herein on Oct. 20, 2015. The rod guide and solids control assembly disclosed in U.S. Pat. No. 9,163,483 may be used with conventional rod pump configurations and, as a rod guide, moves up and down in the tubing and keeps the rods from contacting the tubing as the rods also move up and down in the tubing. However, the rod guide and solids control assembly disclosed in U.S. Pat. No. 9,163,483 does not center the rods in the tubing, since the rod guide has an outer diameter that is smaller than the interior diameter of the tubing, which allows for the rod guide to move from side to side within the tubing. Accordingly, the rod guide and solids control assembly disclosed in U.S. Pat. No. 9,163,483 may not be best-suited for use in a pump configuration utilizing rotating rods since in such a pump configuration, it is desirable to center the rotating rods (which, as noted above, are stationary as to vertical movement) in the tubing.

The present disclosure relates to a rod centralizer and solids control assembly for use with conventional rotational rod pumps for preventing or reducing the amount of solids from reentering back into the pump. It addresses the problems encountered in prior art pumping systems as well as provides other, related advantages.

SUMMARY

In accordance with one embodiment of the present invention, a rod centralizer assembly is disclosed. The rod centralizer assembly comprises, in combination: a top portion, the top portion comprising a top centralizer component; a bottom portion, the bottom portion comprising a bottom centralizer component; and a body portion positioned between the top portion and the bottom portion, the body portion comprising: a brush tube; a helical groove formed on the brush tube and spiraling vertically along a length of at least a lower portion of the brush tube; and a bristle coupled to the brush tube, wherein at least a portion of the bristle is positioned within the groove so that the bristle conforms to a spiral shape of the groove.

In accordance with another embodiment of the present invention, a rod centralizer assembly is disclosed. The rod centralizer assembly comprises, in combination: a top portion, the top portion comprising: a top centralizer component, wherein the top centralizer component includes a helical channel spiraling along a length of the top centralizer component; and a sleeve with clutch; a bottom portion, the bottom portion comprising: a bottom centralizer component, wherein the bottom centralizer component includes a helical channel spiraling along a length of the bottom centralizer component; and a sleeve; and a body portion positioned between the top portion and the bottom portion, the body portion comprising: a brush tube, wherein the brush tube includes a slot extending along a length of the brush tube; a helical groove formed on the brush tube and spiraling vertically along a length of at least a lower portion of the brush tube; and a bristle coupled to the brush tube, wherein at least a portion of the bristle is positioned within the groove so that the bristle conforms to a spiral shape of the groove; a top brush retainer with clutch interposed between the top portion and the body portion; a piston, wherein the piston is configured to be slidably positioned over the brush tube and to receive an upper portion of the bristle, wherein the piston includes at least one set screw configured to be slidably positioned in the slot; a bottom brush retainer interposed between the bottom portion and the body portion; and wherein the bristle is configured to extend from an initiation of one of rod rotation of the rod centralizer assembly and upward fluid movement and retract upon cessation of one of rod rotation of the rod centralizer assembly and a static state of fluid in order to lift and trap solids away from pumped fluid.

In accordance with another embodiment of the present invention, a method for removing solids from pumped fluid using an assembly is disclosed. The method comprises the steps of: providing at least one rod centralizer assembly comprising, in combination: a top portion, the top portion comprising a top centralizer component; a bottom portion, the bottom portion comprising a bottom centralizer component; and a body portion positioned between the top portion and the bottom portion, the body portion comprising: a brush tube; a helical groove formed on the brush tube and spiraling vertically along a length of at least a lower portion of the brush tube; and a bristle coupled to the brush tube, wherein at least a portion of the bristle is positioned within the groove so that the bristle conforms to a spiral shape of the groove; and extending the bristle of the assembly from an initiation of one of rod rotation of the assembly and upward fluid movement; during the extension of the bristle, lifting and trapping solids away from pumped fluid; retracting the bristle of the assembly upon cessation of one of rod rotation of the assembly and a static state of fluid; and during the retraction of the bristle, lifting and trapping solids away from pumped fluid.

BRIEF DESCRIPTION OF DRAWINGS

The present application is further detailed with respect to the following drawings. These figures are not intended to limit the scope of the present application, but rather, illustrate certain attributes thereof. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use and further objectives and advantages thereof, can be best understood by reference to the following detailed description of illustrative embodiments when read in conjunction with the accompanying drawings, wherein.

DESCRIPTION OF THE DISCLOSURE

Figure 1:
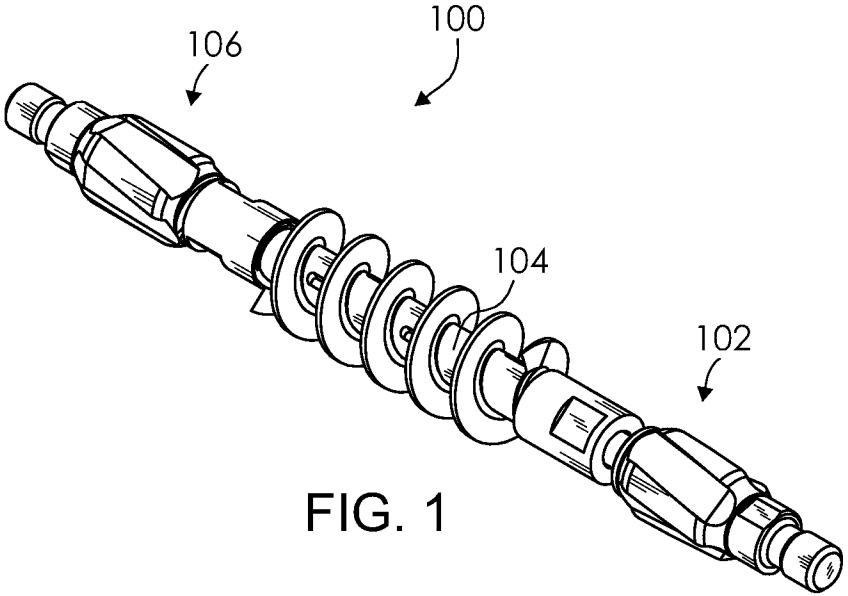
FIG. 1 is a top perspective view of an exemplary rod centralizer and solids control assembly in accordance with one aspect of the present disclosure.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Overview

Generally described, the present disclosure relates to fluid pumps and associated systems and, more particularly, to a rod centralizer and solids control assembly that can be used with a conventional rotational rod pump for preventing solids from reentering into the pump and/or accumulation of solids in tubing. The rod centralizer and solids control assembly can function in well conditions in which high amounts of solids and/or high percentages of water are present. The rod centralizer and solids control assembly can be utilized in well conditions in which the progressive cavity type pump is employed for downhole production recovery. In one illustrative embodiment, the rod centralizer and solids control assembly can be mounted on a rod string, which can be a string of rotational drive rods. The assembly can allow well fluid that contains high solids to pass through tubing under normal operation while preventing the solids from being swept back into the pump stator, or filling the tubing with solids. The assembly can include a body portion coupled to a bristle that extends helically around the body portion. The body portion can be placed on a pump rod, hollow valve rod, or rotational rod. In one illustrative embodiment, when the rods have temporarily stopped rotating or the fluid has become static, the bristles can be locked into place for trapping and holding the solids. During rod rotation or upward fluid movement, the bristles can be rotated for leaving the solids higher and away from a pump intake. This can allow the solids to be lifted out of the pump and thereby prevent solids from collecting on a bottom portion of the pump or tubing. In one illustrative embodiment, the bristle can be coupled to a piston that permits extension of the bristle during upward fluid movement and retraction of the bristle when the rods have temporarily stopped rotating or the fluid has become static. During rod rotation or upward fluid movement, the bristle can extend to allow for fluid passage and trap solids as the fluid flows, leaving the solids higher and away from a pump intake. This can allow the solids to be lifted out of the pump and thereby prevent solids from collecting on a bottom portion of the pump or tubing. When the rods have temporarily stopped rotating or the fluid has become static, the bristle can retract and be held in place while solids present in the fluid can be lifted and then trapped in the bristle. This can prevent the solids from migrating into various areas of the pump assembly and from collecting on a bottom portion of the pump or tubing. The assembly can further include centralizer components that can center the rod and prevent it from rubbing against the steel tubing. In one illustrative embodiment, the assembly can further include synchronizing magnets or other forms of synchronizing components positioned on various components of the assembly. In one illustrative embodiment, the assembly can further include clutching surfaces positioned on various components of the assembly that can be engage upon pump startup. In general, the various embodiments disclosed herein can be utilized to help prevent the rods from becoming over-torqued, which would result in well shutdown. Multiple assemblies can be incorporated into the rod string when solids are more severe.

The FIGURES provide various embodiments of an exemplary rod centralizer and solids control assembly in accordance with various aspects of the present disclosure. The rod centralizer and solids control assembly can be combined in numerous configurations known to those skilled in the relevant art. The assembly can be placed on a string of rods, which can be a string of rotational drive rods. The assembly can also be designed to allow well fluid that contains high solids to pass through the pump or tubing under normal operation or upward fluid movement, but prevent the solids from being swept back into the pump stator or accumulating solids in the tubing on rod rotation in the pump. The assembly can be referred to as a rod centralizer, solids control assembly or combination of both.

Assembly

Turning now to FIG. 1, a top perspective view of an exemplary rod centralizer and solids control assembly 100 in accordance with one aspect of the present disclosure is provided. Portions of the assembly 100 can be made up of a hardened material, such as carbide, an alloy, plastics, polymers, engineered composite or some other suitable material commonly found within such assemblies 100. The rod centralizer and solids control assembly 100 can include a top portion 102 and a bottom portion 106 with a body portion 104 therebetween. In this embodiment, the assembly 100 can have a substantially longitudinal shape and include a one-piece structure incorporating the top portion 102, body portion 104 and bottom portion 106.

The bottom portion 106 can have a diameter equal to the top portion 102, while the body portion 104 generally has a diameter that is smaller than both. The body portion 104 can have a bristle. The diameter of the body portion 104 along with the bristle can be greater than a diameter of the top portion 102 and bottom portion 106.

The bottom portion 106 can include male threading such that it can be coupled to a rod string. This configuration permits the bottom portion 106 of the assembly 100 to be fastened directly into the rod string without the need for any connector components. While the bottom portion 106 can be a male component in this embodiment of the assembly 100, it should be clearly understood that substantial benefit could be derived from an alternate configuration of the bottom portion 106 in which a female threaded component is employed, without departing from the spirit or scope of the present disclosure.

Furthermore, the top portion 102 can include male threading such that it can be coupled to a rod string. This configuration permits the top portion 102 of the assembly 100 to be fastened directly into the rod string without the need for any connector components. While the top portion 102 can be a male component in this embodiment of the assembly 100, it should be clearly understood that substantial benefit could be derived from an alternate configuration of the top portion 102 in which a female threaded component is employed, without departing from the spirit or scope of the present disclosure.

Figure 2:
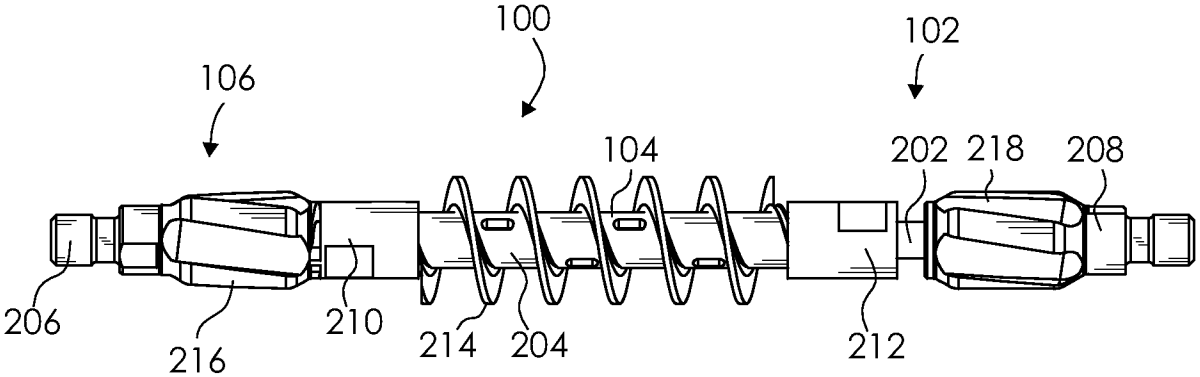
FIG. 2 is a side view of the exemplary rod centralizer and solids control assembly of FIG. 1.

Referring now to FIG. 2, a side view of the exemplary rod centralizer and solids control assembly 100 of FIG. 1 is provided. The assembly 100 can include a rod 202, brush tube 204, end cap with clutch 206, end cap 208, brush retainer with clutch 210, brush retainer 212 and bristle 214. The end cap 208 and brush retainer 212 can be located on the top portion 102 of the rod centralizer and solids control assembly 100. The end cap with clutch 206 and the brush retainer with clutch 210 can be placed on a bottom portion 106 of the assembly 100. Those skilled in the relevant art will appreciate that various combinations of these elements, as well as fewer or additional components, can be added to the assembly 100.

Figure 3:
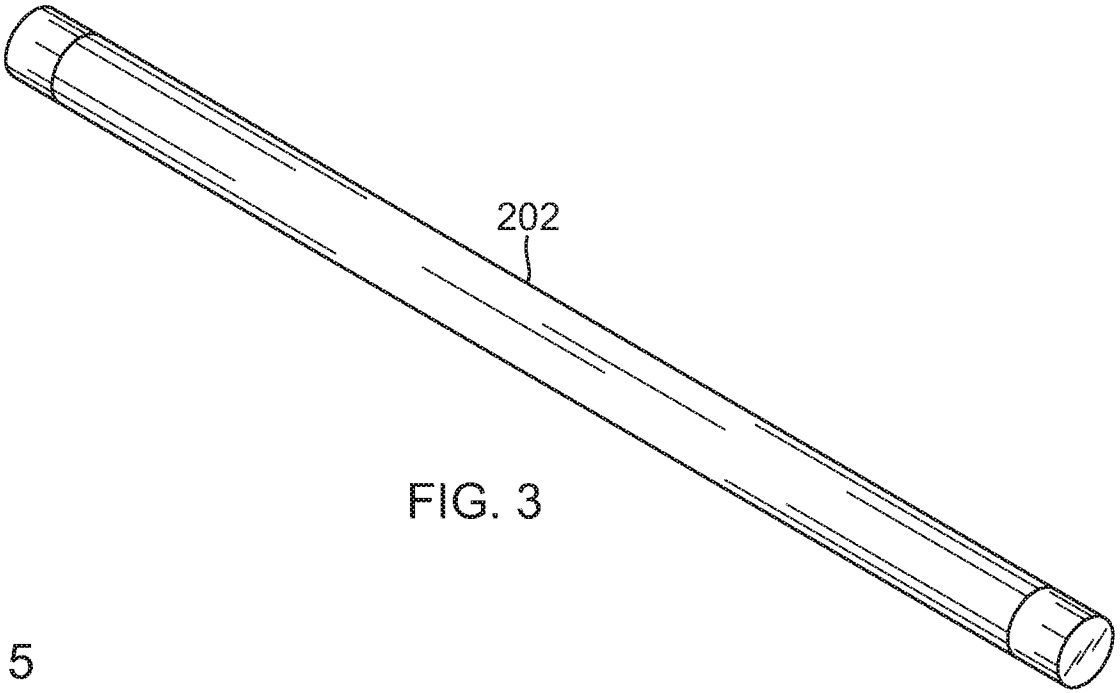
FIG. 3 is a top perspective view of an illustrative rod of the exemplary rod centralizer and solids control assembly of FIG. 1.
Figure 5:
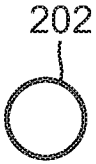
FIG. 5 is a top view of the illustrative rod of FIG. 3.
Figure 4:
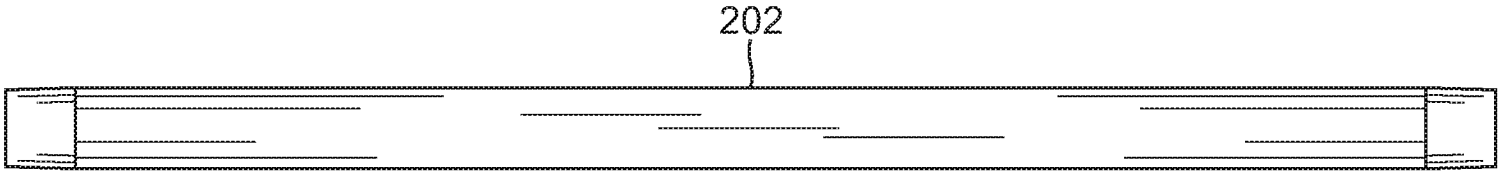
FIG. 4 is a side view of the illustrative rod of FIG. 3.

A rod 202 within the assembly 100 can extend through the bottom portion 106, body portion 104 and top portion 102. Turning to FIG. 3, a top perspective view of an illustrative rod 202 of the exemplary rod centralizer and solids control assembly 100 of FIG. 1 is provided. The rod 202 can have a long cylindrical shape and generally, a diameter less than the bottom portion 106, body portion 104 and top portion 102. Fastening mechanisms can be provided by the rod 202 or other component within the assembly 100 that can securely fasten the rod 202 in place. The rod 202 can be hollow or have a channel therein. Generally, the rod 202 can have a uniform diameter and take on a cylindrical shape. FIG. 4 is a side view of the illustrative rod 202 of FIG. 3, while FIG. 5 is a top view of the illustrative rod 202 of FIG. 3.

Figure 6:
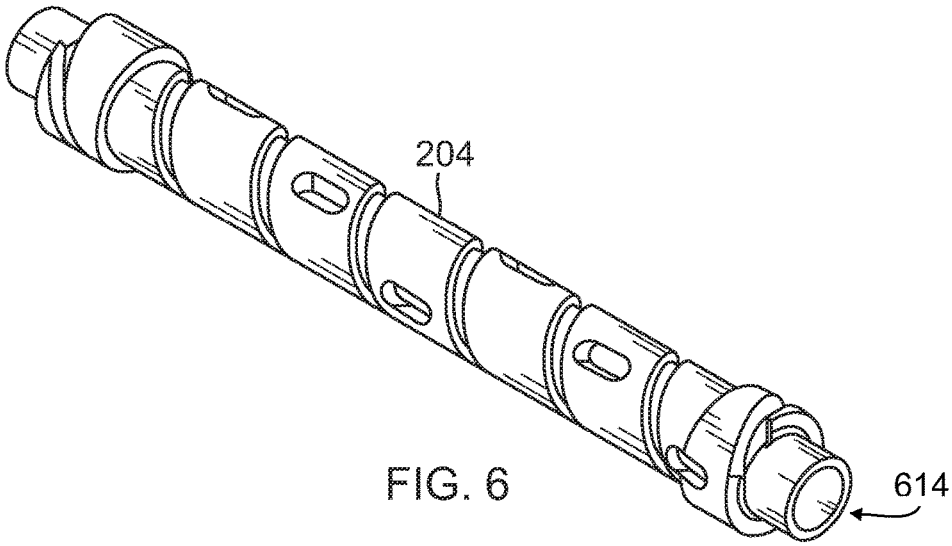
FIG. 6 is a top perspective view of an illustrative brush tube of the exemplary rod centralizer and solids control assembly of FIG. 1 in accordance with one aspect of the present disclosure.
Figure 7:
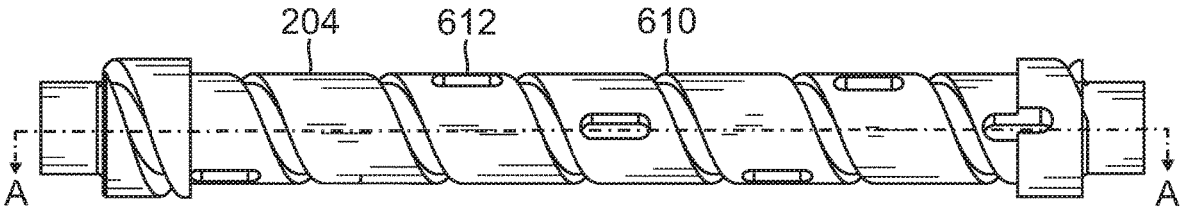
FIG. 7 is a side view of the illustrative brush tube of FIG. 6.

Referring now to FIG. 6, a top perspective view of an illustrative brush tube 204 of the exemplary rod centralizer and solids control assembly 100 of FIG. 1 in accordance with one aspect of the present disclosure is provided. The brush tube 204 can be cylindrical with a center channel 614 running therethrough for the rod 202. In one embodiment, the brush tube 204 can be permitted to float upon the rod 202, such that the brush tube 204 is not permanently affixed to the rod 202. FIG. 7 is a side view of the illustrative brush tube 204 of FIG. 6. A helical groove 610 can be formed on the brush tube 204. The helical groove 610 can spiral around the brush tube 204 at various angles, for example, thirty degrees. The groove 610 can spiral along the length of the brush tube 204. These spirals can create sections between the grooves 610.

Figure 8:
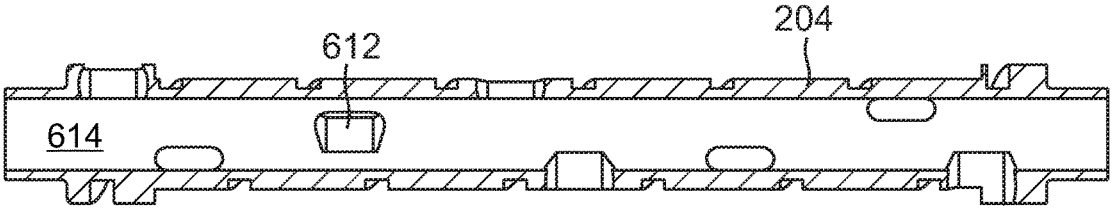
FIG. 8 is a cross-sectional view of the illustrative brush tube of FIG. 7 along line A-A.
Figure 9:
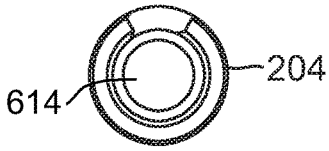
FIG. 9 is a top view of the illustrative brush tube of FIG. 6.

Each section of the brush tube 204 can have an aperture 612. The apertures 612 can lead into the channel 614 of the brush tube 602. The apertures 612 within each of the sections can also spiral downwards. Other patterns for the apertures 612 can be incorporated within the brush tube 204 known to those skilled in the relevant art. FIG. 8 is a cross-sectional view of the illustrative brush tube 204 of FIG. 7 along line A-A. The internal channel 614 can be hollow with apertures 612 extending to the outside of the brush tube 204. FIG. 9 is a top view of illustrative brush tube 204 of FIG. 6.

Figure 10:
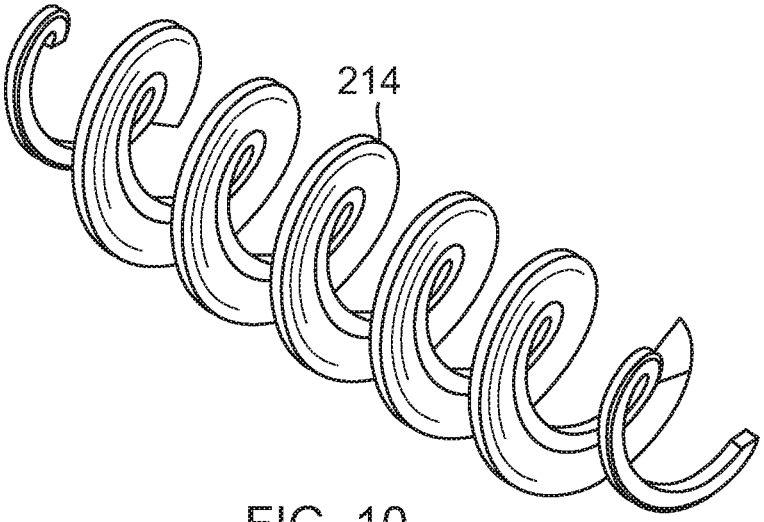
FIG. 10 is a top perspective view of an illustrative bristle of the exemplary rod centralizer and solids control assembly of FIG. 1 in accordance with one aspect of the present disclosure.
Figure 11:
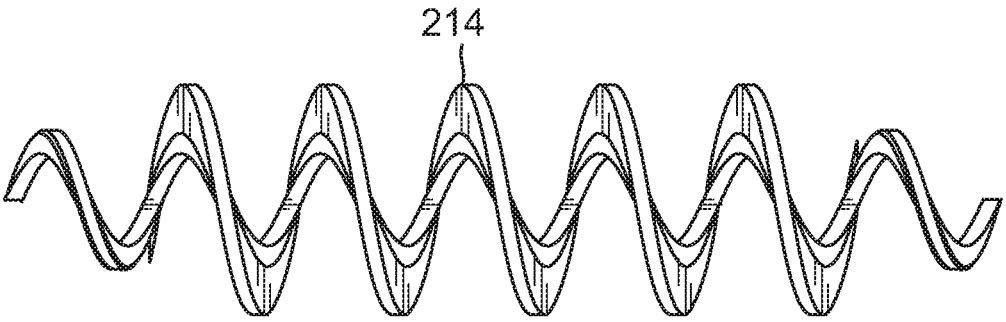
FIG. 11 is a side view of the illustrative bristle of FIG. 10.
Figure 12:
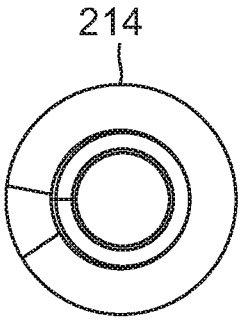
FIG. 12 is a top view of the illustrative bristle of FIG. 10.

Referring to FIG. 10, a top perspective view of an illustrative bristle 214 of the exemplary rod centralizer and solids control assembly 100 of FIG. 1 in accordance with one aspect of the present disclosure is provided. The bristle 214 can have a spiral shape and conform to the groove 610 of the brush tube 204. FIG. 11 is a side view of the illustrative bristle 214 of FIG. 10, while FIG. 12 is a top view of illustrative bristle 214 of FIG. 10.

The bristle 214, in one embodiment, can be helical and spiral around the groove 610 of the assembly 100. The bristle 214 can be configured at different angles, for example, at thirty degrees. The bristle 214 can be made of a wide variety of materials. These materials can include, but are not limited to, steel, plastic, high temperature nylon, polymer, etc. and can depend on conditions of the pump. The bristle 214 can extend between the bottom portion 106 and the top portion 102. The bristles 214 can generally be spaced equidistant from each other.

Figure 13:
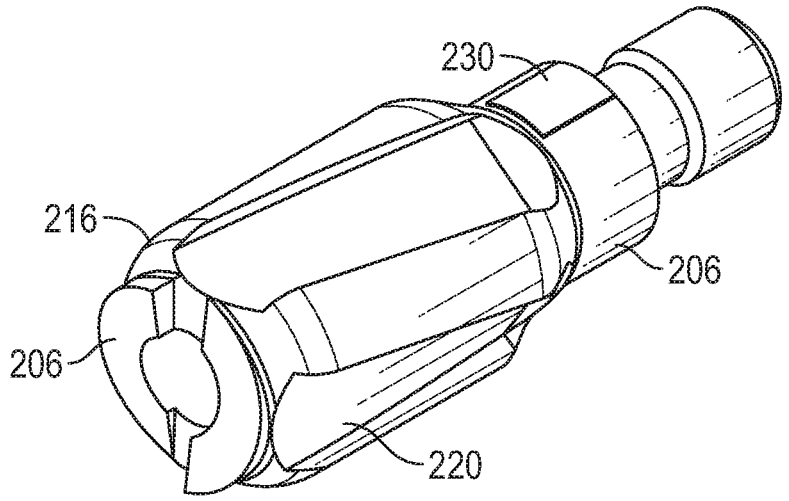
FIG. 13 is a top perspective view of an illustrative end cap with clutch fitted with a bottom centralizer component of the exemplary rod centralizer and solids control assembly of FIG. 1 in accordance with one aspect of the present disclosure.

Turning to FIG. 13, a top perspective view of an illustrative end cap with clutch 206 fitted with a bottom centralizer component 216 of the exemplary rod centralizer and solids control assembly 100 of FIG. 1 in accordance with one aspect of the present disclosure is provided. The end cap with clutch 206 can include a pair of wrench flats 230 on opposing sides thereof to facilitate coupling and de-coupling of the end cap with clutch 206 to other components of the assembly 100. The end cap with clutch 206 can work in tandem with the brush retainer with clutch 210. The end cap with clutch 206 can tightly secure the components of the assembly 100.

The bottom centralizer component 216 can be positioned around an outer portion of the end cap with clutch 206. The bottom centralizer component 216 can be made up of a hardened, heat-treated material, such as carbide, an alloy, plastics, polymers, engineered composite or some other suitable material. Generally, the bottom centralizer component 216 can have a cylindrical shape and a diameter greater than the end cap with clutch 206. In one embodiment, the outer diameter of the bottom centralizer component 216 can be slightly less than the interior diameter of the tubing. This will help to prevent the assembly 100 from moving from side to side within the tubing. The bottom centralizer component 216 can include elongated channels 220. Channels 220 permit the passage of fluid therethrough. While the number of channels 220 may be varied, four channels 220 are preferred. In one embodiment, the channels 220 may be helical and oriented on an upward angle. Channels 220 can generally be spaced equidistant from each other.

With respect to the positioning of the bottom centralizer component 216, in one embodiment the bottom centralizer component 216 is not permanently affixed to the end cap with clutch 206 but, rather, is held in place around the end cap with clutch 206 by friction. In this way, the bottom centralizer component 216 is permitted to float upon the end cap with clutch 206. There can be a slight interference fit between the bottom centralizer component 216 and the end cap with clutch 206.

Figure 14:
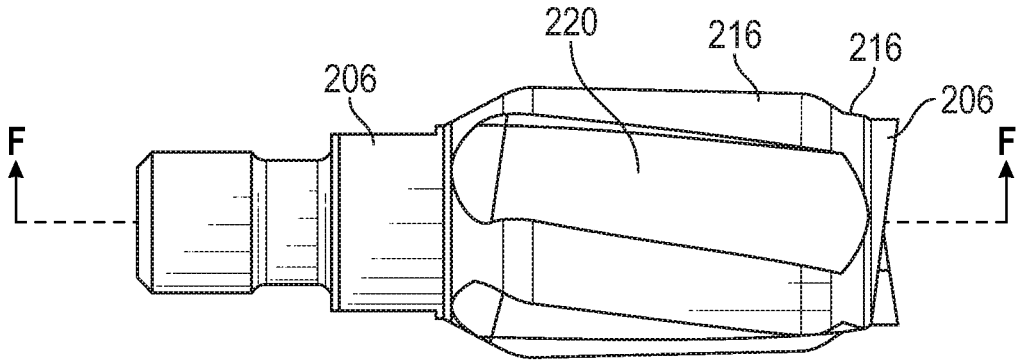
FIG. 14 is a side view of the illustrative end cap with clutch of FIG. 13.
Figure 15:
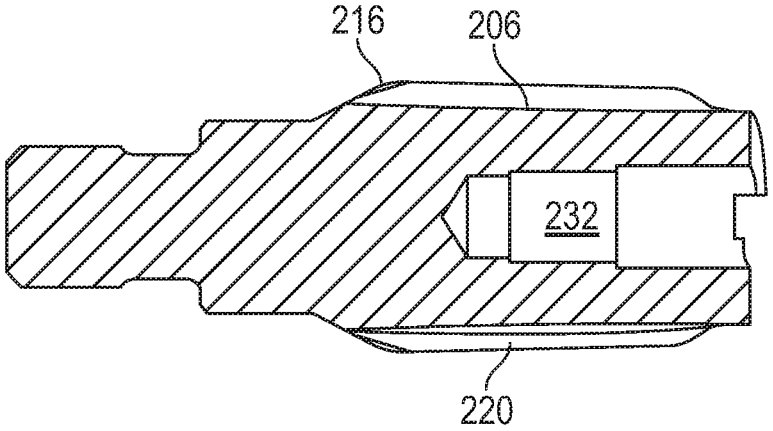
FIG. 15 is a cross-sectional view of the illustrative end cap with clutch of FIG. 14 along line F-F.
Figure 16:
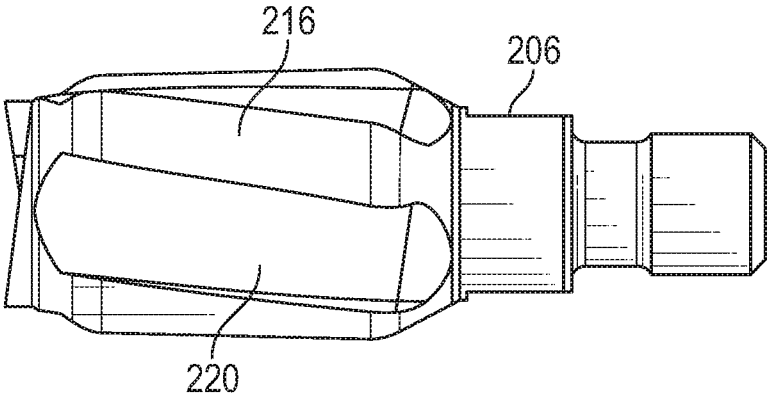
FIG. 16 is a side view of the illustrative end cap with clutch of FIG. 13.
Figure 17:
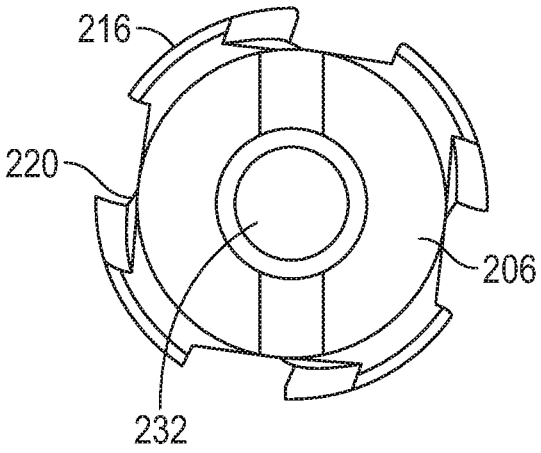
FIG. 17 is a top view of illustrative end cap with clutch of FIG. 13.

FIG. 14 is a side view of the illustrative end cap with clutch 206, fitted with the bottom centralizer component 216, of FIG. 13. FIG. 15 is a cross-sectional view of the illustrative end cap with clutch 206, fitted with the bottom centralizer component 216, of FIG. 14 along line F-F. As shown, the end cap with clutch 206 can include an inlet 232 where the rod 202 can be fitted. FIG. 16 is a side view of the illustrative end cap with clutch 206, fitted with the bottom centralizer component 216, of FIG. 13. FIG. 17 is a top view of illustrative end cap with clutch 206, fitted with the bottom centralizer component 216, of FIG. 13.

Figure 18:
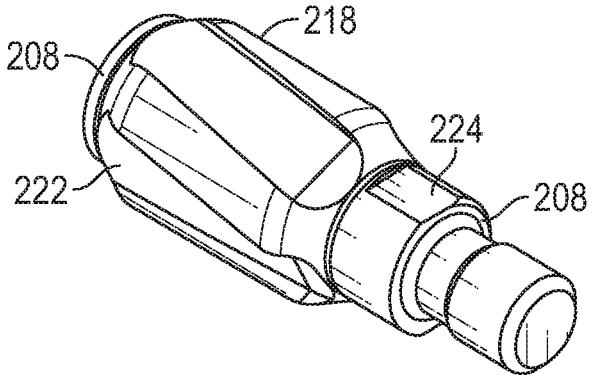
FIG. 18 is a top perspective view of an illustrative end cap fitted with a top centralizer component of the exemplary rod centralizer and solids control assembly of FIG. 1 in accordance with one aspect of the present disclosure.

On the other end of the rod centralizer and solids control assembly 100, an end cap 208 is provided as shown in FIG. 18, which is a top perspective view of an illustrative end cap 208 fitted with a top centralizer component 218 of the exemplary rod centralizer and solids control assembly 100 of FIG. 1 in accordance with one aspect of the present disclosure. The end cap 208 can include a pair of wrench flats 224 on opposing sides thereof to facilitate coupling and de-coupling of the end cap 208 to other components of the assembly 100. The end cap 208 can work in tandem with the brush retainer 212. The end cap 208 can tightly secure the components of the assembly 100. The end cap 208 can be coupled to the brush retainer 212 or be separated therefrom.

The top centralizer component 218 can be positioned around an outer portion of the end cap 208. Like the bottom centralizer component 216, the top centralizer component 218 can be made up of a hardened, heat-treated material, such as carbide, an alloy, plastics, polymers, engineered composite or some other suitable material. Generally, the top centralizer component 218 can have a cylindrical shape and a diameter greater than the end cap 208. In one embodiment, the outer diameter of the top centralizer component 218 can be slightly less than the interior diameter of the tubing. This will help to prevent the assembly 100 from moving from side to side within the tubing. The top centralizer component 218 can include elongated channels 222. Channels 222 permit the passage of fluid therethrough. While the number of channels 222 may be varied, four channels 222 are preferred. In one embodiment, the channels 222 may be helical and oriented on an upward angle. Channels 222 can generally be spaced equidistant from each other.

With respect to the positioning of the top centralizer component 218, in one embodiment the top centralizer component 218 is not permanently affixed to the end cap 208 but, rather, is held in place around the end cap 208 by friction. In this way, the top centralizer component 218 is permitted to float upon the end cap 208. There can be a slight interference fit between the top centralizer component 218 and the end cap 208.

Figure 19:
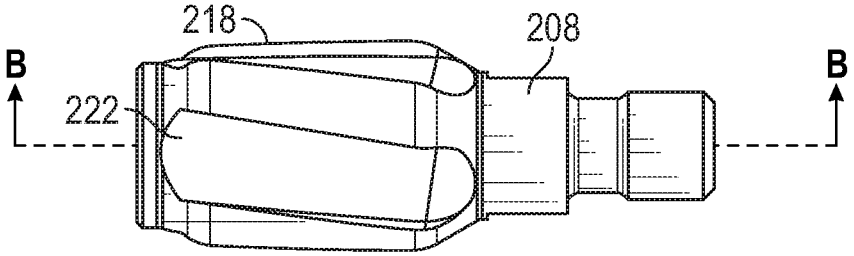
FIG. 19 is a side view of the illustrative end cap of FIG. 18.
Figure 20:
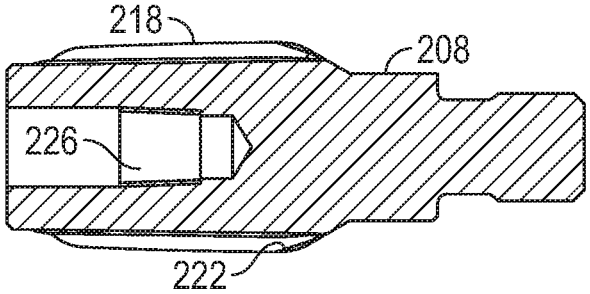
FIG. 20 is a cross-sectional view of the illustrative end cap of FIG. 19 along line B-B.
Figure 21:
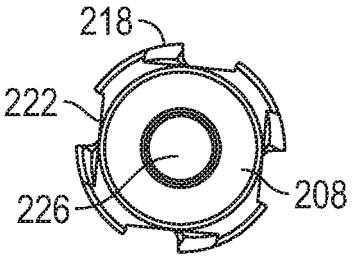
FIG. 21 is a top view of illustrative end cap of FIG. 18.

FIG. 19 is a side view of the illustrative end cap 208, fitted with the top centralizer component 218, of FIG. 18. FIG. 20 is a cross-sectional view of the illustrative end cap 208, fitted with the top centralizer component 218, of FIG. 19 along line B-B. The end cap 208 can include an inlet 226 that can be fitted to the rod 202. FIG. 21 is a top view of illustrative end cap 208, fitted with the top centralizer component 218, of FIG. 18.

Figure 22:
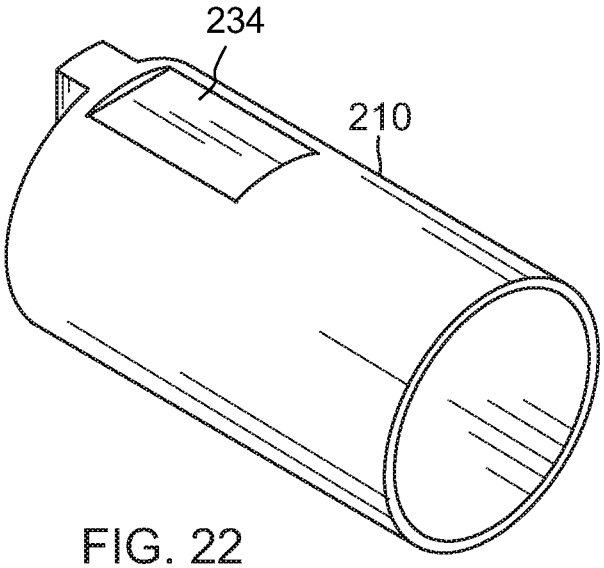
FIG. 22 is a top perspective view of an illustrative brush retainer with clutch of the exemplary rod centralizer and solids control assembly of FIG. 1 in accordance with one aspect of the present disclosure.
Figure 23:
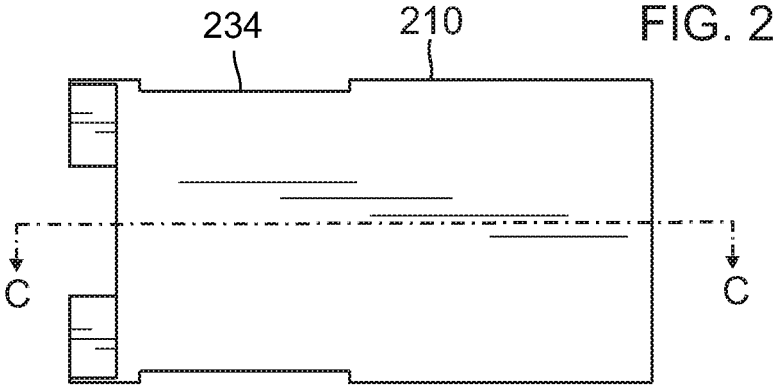
FIG. 23 is a side view of the illustrative brush retainer with clutch of FIG. 22.
Figure 24:
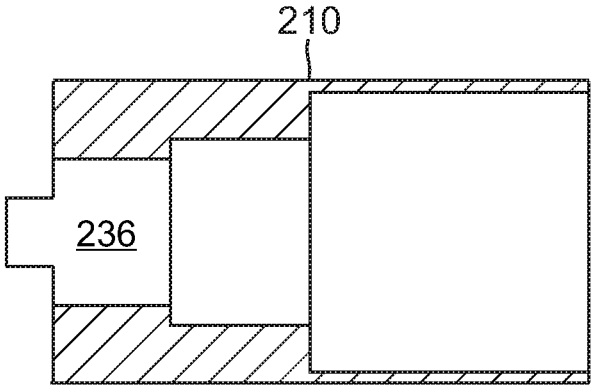
FIG. 24 is a cross-sectional view of the illustrative brush retainer with clutch of FIG. 23 along line C-C.
Figure 25:
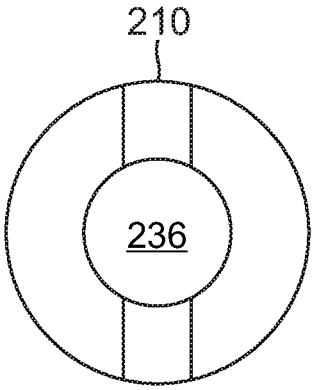
FIG. 25 is a top view of the illustrative brush retainer with clutch of FIG. 22.

Referring to FIG. 22, a top perspective view of an illustrative brush retainer with clutch 210 of the exemplary rod centralizer and solids control assembly 100 of FIG. 1 in accordance with one aspect of the present disclosure is provided. The brush retainer with clutch 210 can include an inlet 236 (see FIGS. 24-25) for receiving the rod 202. The brush retainer with clutch 210 can include a pair of wrench flats 234 on opposing sides thereof to facilitate coupling and de-coupling of the brush retainer with clutch 210 to other components of the assembly 100. FIG. 23 is a side view of the illustrative brush retainer with clutch 210 of FIG. 22. FIG. 24 is a cross-sectional view of the illustrative brush retainer with clutch 210 of FIG. 23 along line C-C. FIG. 25 is a top view of illustrative brush retainer with clutch 210 of FIG. 22.

Figure 26:
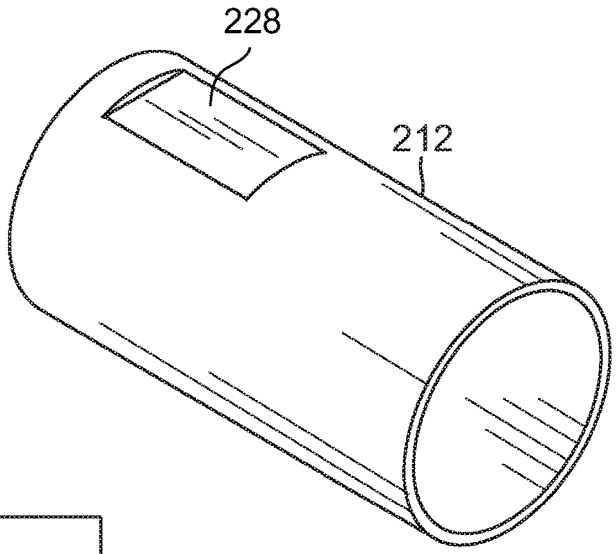
FIG. 26 is a top perspective view of an illustrative brush retainer of the exemplary rod centralizer and solids control assembly of FIG. 1 in accordance with one aspect of the present disclosure.
Figure 27:
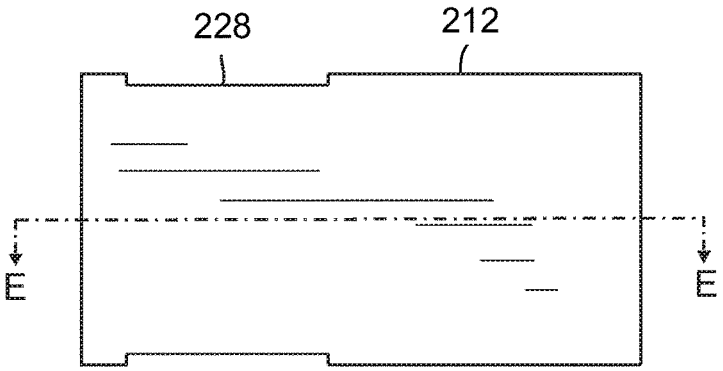
FIG. 27 is a side view of the illustrative brush retainer of FIG. 26.
Figure 28:
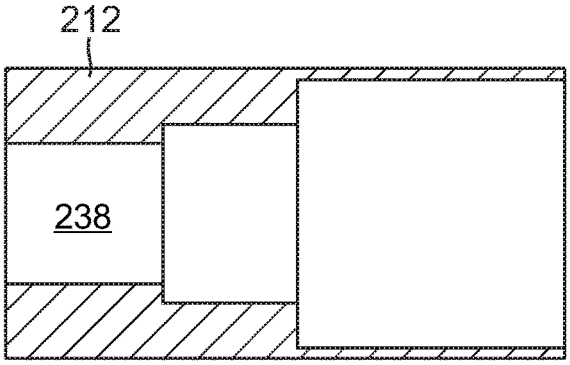
FIG. 28 is a cross-sectional view of the illustrative brush retainer of FIG. 27 along line E-E.
Figure 29:
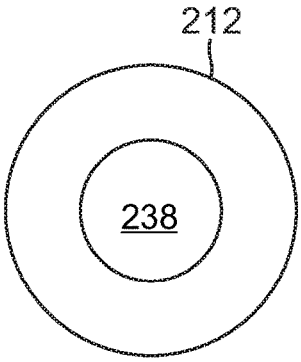
FIG. 29 is a top view of the illustrative brush retainer of FIG. 26.

Turning to FIG. 26, a top perspective view of an illustrative brush retainer 212 of the exemplary rod centralizer and solids control assembly 100 of FIG. 1 in accordance with one aspect of the present disclosure is provided. The brush retainer 212 can include an inlet 238 (see FIGS. 28-29) for receiving the rod 202. The brush retainer 212 can include a pair of wrench flats 228 on opposing sides thereof to facilitate coupling and de-coupling of the brush retainer 212 to other components of the assembly 100. FIG. 27 is a side view of the illustrative brush retainer 212 of FIG. 26. FIG. 28 is a cross-sectional view of the illustrative brush retainer 212 of FIG. 27 along line E-E and FIG. 29 is a top view of illustrative brush retainer 212 of FIG. 26.

Figure 30:
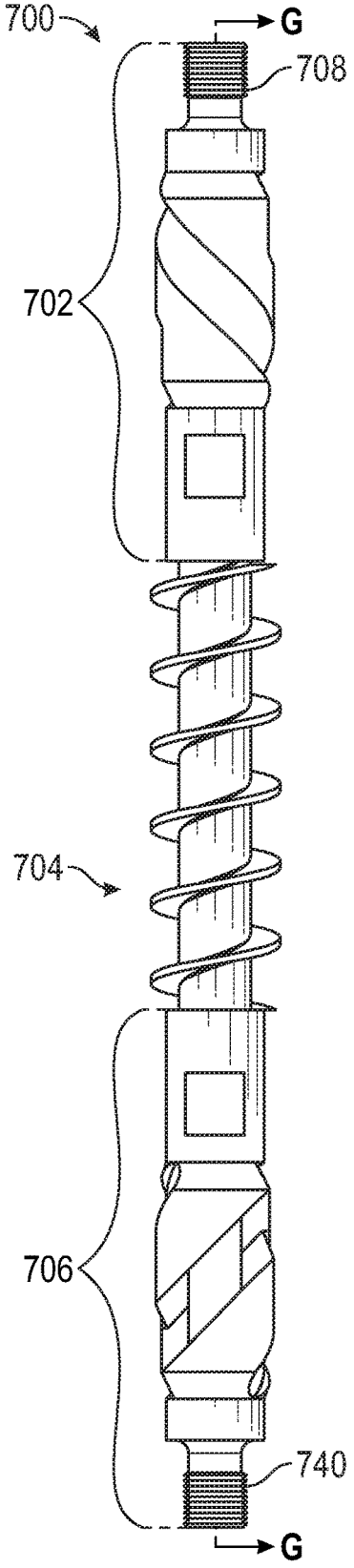
FIG. 30 is a side view of another embodiment of an exemplary rod centralizer and solids control assembly in accordance with one aspect of the present disclosure.
Figure 31:
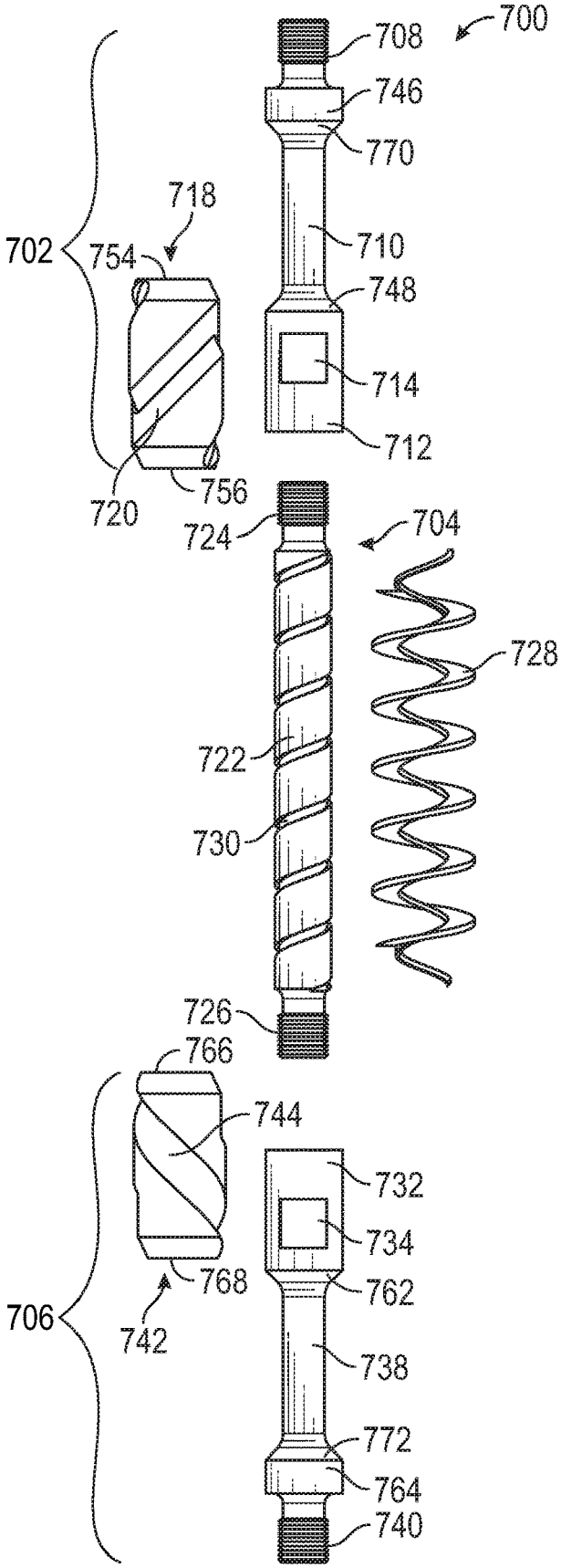
FIG. 31 is an side, exploded view of the exemplary rod centralizer and solids control assembly of FIG. 30.
Figure 32:
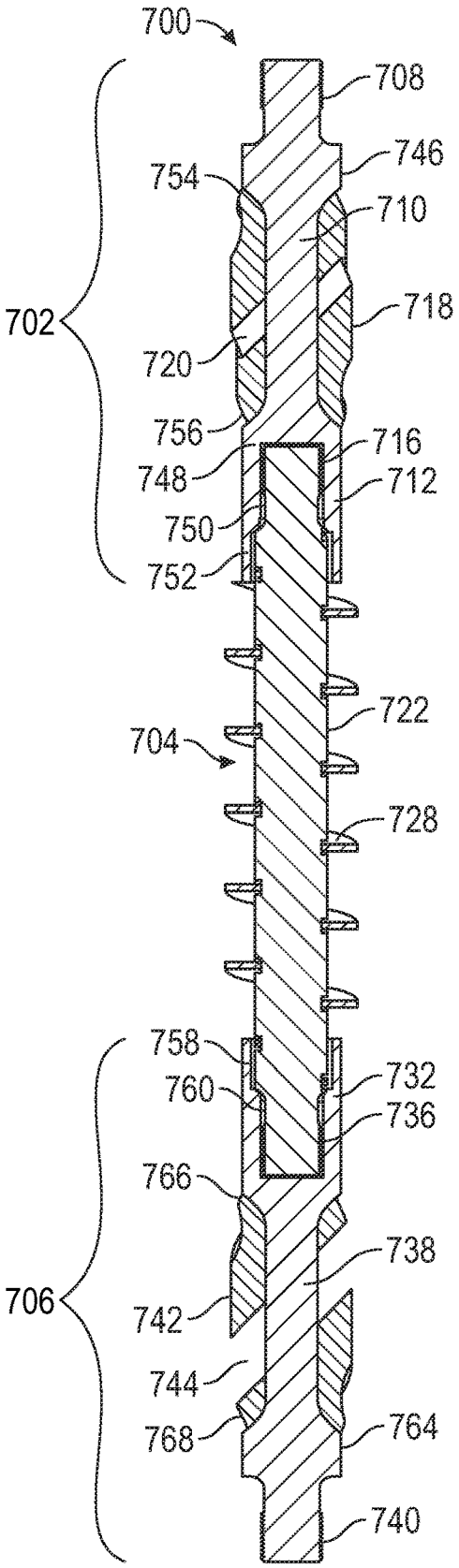
FIG. 32 is a cross-sectional view of the exemplary rod centralizer and solids control assembly of FIG. 30 along line G-G.

FIGS. 30-32 show another embodiment of a rod centralizer and solids control assembly, hereinafter rod centralizer and solids control assembly 700. Turning now to FIG. 30, a side view of an exemplary rod centralizer and solids control assembly 700 in accordance with one aspect of the present disclosure is provided. Portions of the assembly 700 can be made up of a hardened material, such as carbide, an alloy, plastics, polymers, engineered composite or some other suitable material commonly found within such assemblies 700. The rod centralizer and solids control assembly 700 can include a top portion 702 and a bottom portion 706 with a body portion 704 therebetween. In this embodiment, the assembly 700 can have a substantially longitudinal shape and include a one-piece structure incorporating the top portion 702, body portion 704 and bottom portion 706.

The bottom portion 706 can have an overall diameter equal to that of the top portion 702, while the body portion 704 generally has a diameter that is smaller than both. The body portion 704 can have a bristle. The diameter of the body portion 704 along with the bristle can be greater than a diameter of the top portion 702 and bottom portion 706.

The bottom portion 706 can include a lower threaded region 740 such that it can be coupled to a rod string. This configuration permits the bottom portion 706 of the assembly 700 to be fastened directly into the rod string without the need for any connector components. According to one embodiment, lower threaded region 740 can comprise a one-inch sucker rod pin thread or the like. While the lower threaded region 740 is shown as comprising male threading, it should be clearly understood that substantial benefit could be derived from an alternate configuration of the lower threaded region 740 in which a female threading is employed, without departing from the spirit or scope of the present disclosure.

Furthermore, the top portion 702 can include an upper threaded region 708 such that it can be coupled to a rod string. This configuration permits the top portion 702 of the assembly 700 to be fastened directly into the rod string without the need for any connector components. According to one embodiment, upper threaded region 708 can comprise a one-inch sucker rod pin thread or the like. While the upper threaded region 708 is shown as comprising male threading, it should be clearly understood that substantial benefit could be derived from an alternate configuration of the upper threaded region 708 in which a female threading is employed, without departing from the spirit or scope of the present disclosure.

Referring now to FIG. 31, a side, exploded view of the exemplary rod centralizer and solids control assembly 700 of FIG. 30 is provided. In addition to the top portion 702 and bottom portion 706, the assembly 700 can generally include a brush tube 722 and bristle 728. The top portion 702 can include a shaft 710 and a sleeve 712. A top centralizer component 718 can be positioned around the shaft 710. The bottom portion 706 can include a shaft 738 and a sleeve 732. A bottom centralizer component 742 can be positioned around the shaft 738. Those skilled in the relevant art will appreciate that various combinations of these elements, as well as fewer or additional components, can be added to the assembly 700.

Referring to FIGS. 31-32, the top portion 702 will be discussed in further detail. The top portion 702 can include a shoulder 746 positioned above the shaft 710. The shaft 710 of the top portion 702 can take on a cylindrical shape and can generally be positioned between the upper threaded region 708 and sleeve 712. The sleeve 712 can include an upper portion 748 and an inlet 750 for receiving an upper portion of the brush tube 722. The sleeve 712 can include an upper threaded region 716 configured to mate with an upper threaded region 724 of the brush tube 722, as discussed further herein. The sleeve 712 can include a pair of wrench flats 714 on opposing sides thereof to facilitate coupling and de-coupling of the top portion 702 to other components of the assembly 700. The sleeve 712 can include a lower non-threaded region 752 configured to receive an upper portion of the brush tube 722, as discussed further herein.

The top centralizer component 718 can be positioned around an outer portion of the shaft 710. The top centralizer component 718 can generally include an upper portion 754, a lower portion 756, and a center channel running therethrough. The upper portion 754 of the top centralizer component 718 can abut a lower portion 770 of the shoulder 746, while the lower portion 756 of the top centralizer component 718 can abut an upper portion 748 of the sleeve 712. The top centralizer component 718 can be made up of a hardened, heat-treated material, such as carbide, an alloy, plastics, polymers, engineered composite or some other suitable material. Generally, the top centralizer component 718 can have a cylindrical shape and an overall diameter greater than the sleeve 712. In one embodiment, the outer diameter of the top centralizer component 718 can be slightly less than the interior diameter of the tubing. This will help to prevent the assembly 700 from moving from side to side within the tubing. The top centralizer component 718 can include an elongated channel 720. Channel 720 permits the passage of fluid therethrough. In one embodiment, channel 720 may be helical and can spiral around the top centralizer component 718 at various angles. The channel 720 can spiral along the length of the top centralizer component 718.

With respect to the positioning of the top centralizer component 718, in one embodiment the top centralizer component 718 is not permanently affixed to the shaft 710 but, rather, is held in place around the shaft 710 by friction. In this way, the top centralizer component 718 is permitted to float upon the shaft 710. There can be a slight interference fit between the top centralizer component 718 and the shaft 710.

Referring still to FIGS. 31-32, the brush tube 722 will be discussed in further detail. The brush tube 722 can be cylindrical. The brush tube 722 can include an upper threaded region 724 such that it can be coupled to the sleeve 712 of the top portion 702. When upper threaded region 724 is coupled to upper threaded region 716 of the sleeve 712, it can be seen that an upper portion of the brush tube 722 including a portion of bristle 728 mates with lower non-threaded region 752 of the sleeve 712. In this way, the sleeve 712 is configured to cover a portion of the bristle 728 and hold it in place. The brush tube 722 can include a lower threaded region 726 such that it can be coupled to the sleeve 732 of the bottom portion 706. When lower threaded region 726 is coupled to a lower threaded region 736 of the sleeve 732, it can be seen that a lower portion of the brush tube 722 including a portion of bristle 728 mates with an upper non-threaded region 758 of the sleeve 732. In this way, the sleeve 732 is configured to cover a portion of the bristle 728 and hold it in place. According to one embodiment, upper threaded region 724 and lower threaded region 726 can each comprise a one-inch sucker rod pin thread or the like. While the upper threaded region 724 and lower threaded region 726 are each shown as comprising male threading, it should be clearly understood that substantial benefit could be derived from an alternate configuration of the upper threaded region 724, lower threaded region 726, or both, in which female threading is employed, without departing from the spirit and scope of the present disclosure. A helical groove 730 can be formed on the brush tube 722. The helical groove 730 can spiral around the brush tube 722 at various angles, for example, thirty degrees. The helical groove 730 can spiral along the length of the brush tube 722. These spirals can create sections between the grooves 730.

Referring still to FIGS. 31-32, the bristle 728 will be discussed in further detail. The bristle 728 can have a spiral shape and conform to the groove 730 of the brush tube 722. The bristle 728, in one embodiment, can be helical and spiral around the groove 730 of the assembly 700. The bristle 728 can be configured at different angles, for example, at thirty degrees. The bristle 728 can be made of a wide variety of materials. These materials can include, but are not limited to, steel, plastic, high temperature nylon, polymer, etc. and can depend on conditions of the pump. The bristle 728 can extend between the bottom portion 706 and the top portion 702. The bristles 728 can generally be spaced equidistant from each other.

Referring still to FIGS. 31-32, the bottom portion 706 will be discussed in further detail. The bottom portion 706 can include a shoulder 764 positioned below the shaft 738. The shaft 738 of the bottom portion 706 can take on a cylindrical shape and can generally be positioned between the lower threaded region 740 and sleeve 732. The sleeve 732 can include a lower portion 762 and an inlet 760 for receiving a lower portion of the brush tube 722. The sleeve 732 can include a lower threaded region 736 configured to mate with the lower threaded region 726 of the brush tube 722. The sleeve 732 can include a pair of wrench flats 734 on opposing sides thereof to facilitate coupling and de-coupling of the bottom portion 706 to other components of the assembly 700. The sleeve 732 can include an upper non-threaded region 758 configured to receive a lower portion of the brush tube 722, as discussed above.

The bottom centralizer component 742 can be positioned around an outer portion of the shaft 738. The bottom centralizer component 742 can generally include an upper portion 766, a lower portion 768, and a center channel running therethrough. The lower portion 768 of the bottom centralizer component 742 can abut an upper portion 772 of the shoulder 764, while the upper portion 766 of the bottom centralizer component 742 can abut a lower portion 762 of the sleeve 732. The bottom centralizer component 742 can be made up of a hardened, heat-treated material, such as carbide, an alloy, plastics, polymers, engineered composite or some other suitable material. Generally, the bottom centralizer component 742 can have a cylindrical shape and an overall diameter greater than the sleeve 732. In one embodiment, the outer diameter of the bottom centralizer component 742 can be slightly less than the interior diameter of the tubing. This will help to prevent the assembly 700 from moving from side to side within the tubing. The bottom centralizer component 742 can include an elongated channel 744. Channel 744 permits the passage of fluid therethrough. In one embodiment, channel 744 may be helical and can spiral around the bottom centralizer component 742 at various angles. The channel 744 can spiral along the length of the bottom centralizer component 742.

With respect to the positioning of the bottom centralizer component 742, in one embodiment the bottom centralizer component 742 is not permanently affixed to the shaft 738 but, rather, is held in place around the shaft 738 by friction. In this way, the bottom centralizer component 742 is permitted to float upon the shaft 738. There can be a slight interference fit between the bottom centralizer component 742 and the shaft 738.

Figure 33:
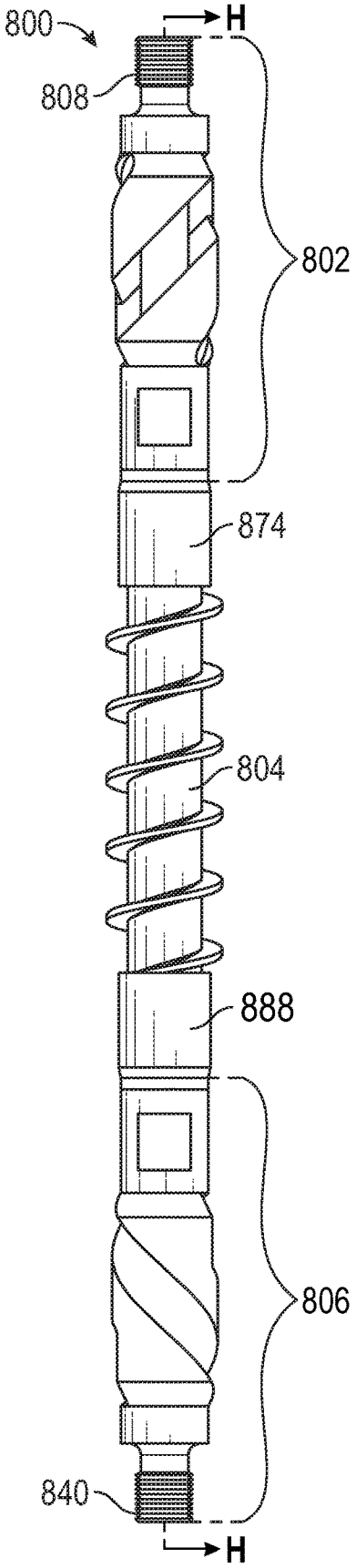
FIG. 33 is a side view of another embodiment of an exemplary rod centralizer and solids control assembly in accordance with one aspect of the present disclosure.

FIGS. 33-37 show another embodiment of a rod centralizer and solids control assembly, hereinafter rod centralizer and solids control assembly 800. Turning now to FIG. 33, a side view of an exemplary rod centralizer and solids control assembly 800 in accordance with one aspect of the present disclosure is provided. Portions of the assembly 800 can be made up of a hardened material, such as carbide, an alloy, plastics, polymers, engineered composite or some other suitable material commonly found within such assemblies 800. The rod centralizer and solids control assembly 800 can include a top portion 802 and a bottom portion 806 with a body portion 804 therebetween. Further, the rod centralizer and solids control assembly 800 can include a top brush retainer 874 interposed between the top portion 802 and body 804, and a bottom brush retainer 888 interposed between the bottom portion 806 and body 804. In this embodiment, the assembly 800 can have a substantially longitudinal shape and include a one-piece structure incorporating the top portion 802, body portion 804, bottom portion 806, top brush retainer 874, and bottom brush retainer 888.

The bottom portion 806 can have an overall diameter equal to that of the top portion 802, while the body portion 804 generally has a diameter that is smaller than both. Further, the bottom brush retainer 888 can have an overall diameter equal to that of the top brush retainer 874, while the body portion 804 generally has a diameter that is smaller than both. The body portion 804 can have a bristle. The diameter of the body portion 804 along with the bristle can be greater than a diameter of the top portion 802, bottom portion 806, top brush retainer 874, and bottom brush retainer 888.

The bottom portion 806 can include a lower threaded region 840 such that it can be coupled to a rod string. This configuration permits the bottom portion 806 of the assembly 800 to be fastened directly into the rod string without the need for any connector components. According to one embodiment, lower threaded region 840 can comprise a one-inch sucker rod pin thread or the like. While the lower threaded region 840 is shown as comprising male threading, it should be clearly understood that substantial benefit could be derived from an alternate configuration of the lower threaded region 840 in which a female threading is employed, without departing from the spirit or scope of the present disclosure.

Furthermore, the top portion 802 can include an upper threaded region 808 such that it can be coupled to a rod string. This configuration permits the top portion 802 of the assembly 800 to be fastened directly into the rod string without the need for any connector components. According to one embodiment, upper threaded region 808 can comprise a one-inch sucker rod pin thread or the like. While the upper threaded region 808 is shown as comprising male threading, it should be clearly understood that substantial benefit could be derived from an alternate configuration of the upper threaded region 808 in which a female threading is employed, without departing from the spirit or scope of the present disclosure.

Figure 34:
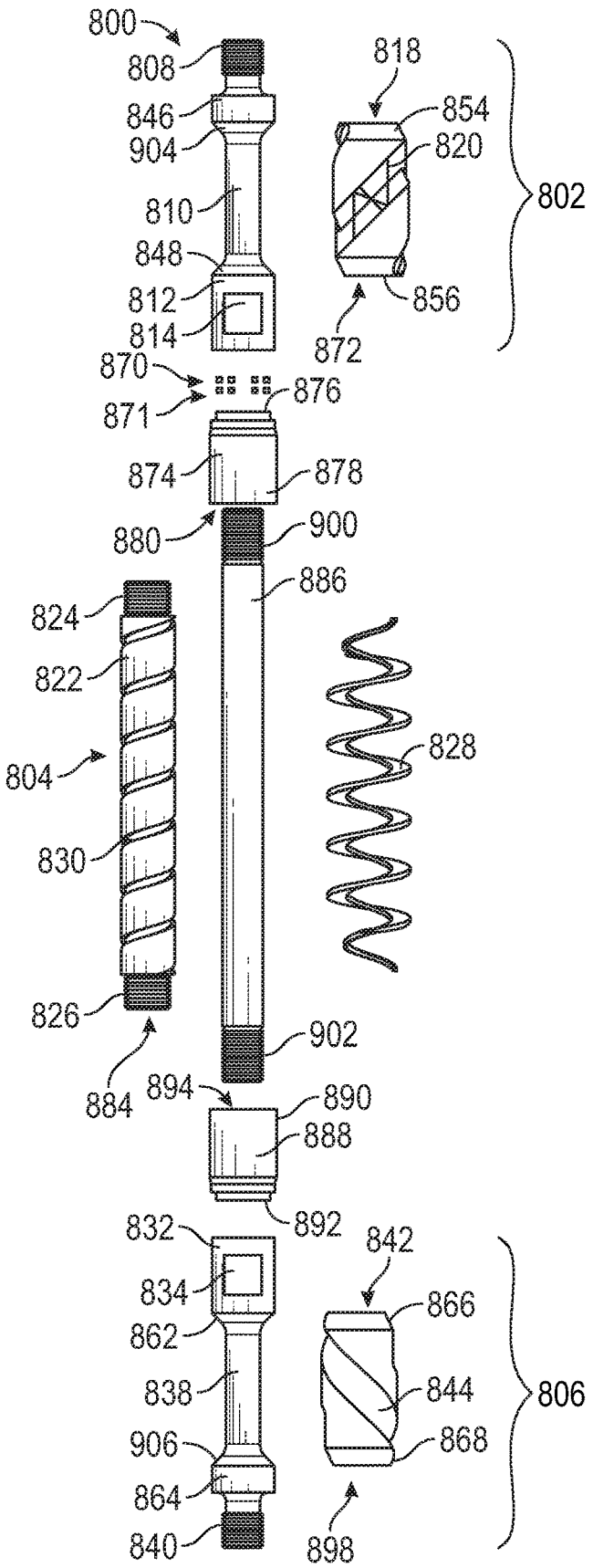
FIG. 34 is an side, exploded view of the exemplary rod centralizer and solids control assembly of FIG. 33.

Referring now to FIG. 34, a side, exploded view of the exemplary rod centralizer and solids control assembly 800 of FIG. 33 is provided. In addition to the top portion 802, top brush retainer 874, bottom portion 806, and bottom brush retainer 888, the assembly 800 can generally include a brush tube 822 and bristle 828. The top portion 802 can include a shaft 810 and a sleeve 812. A top centralizer component 818 can be positioned around the shaft 810. The bottom portion 806 can include a shaft 838 and a sleeve 832. A bottom centralizer component 842 can be positioned around the shaft 838. Those skilled in the relevant art will appreciate that various combinations of these elements, as well as fewer or additional components, can be added to the assembly 800.

Figure 35:
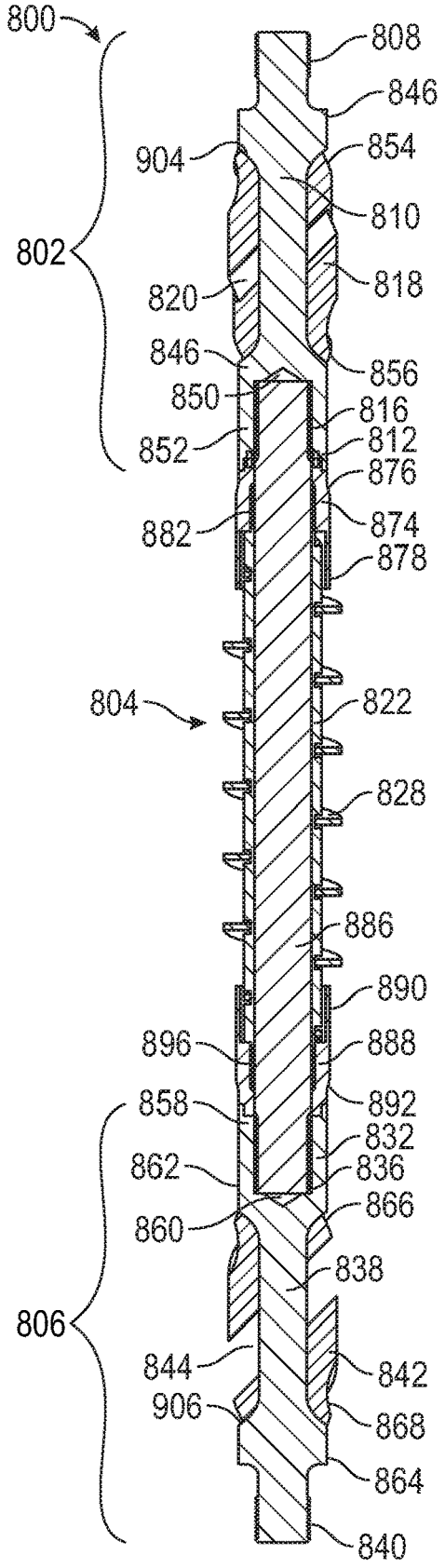
FIG. 35 is a cross-sectional view of the exemplary rod centralizer and solids control assembly of FIG. 33 along line H-H.
Figure 36:
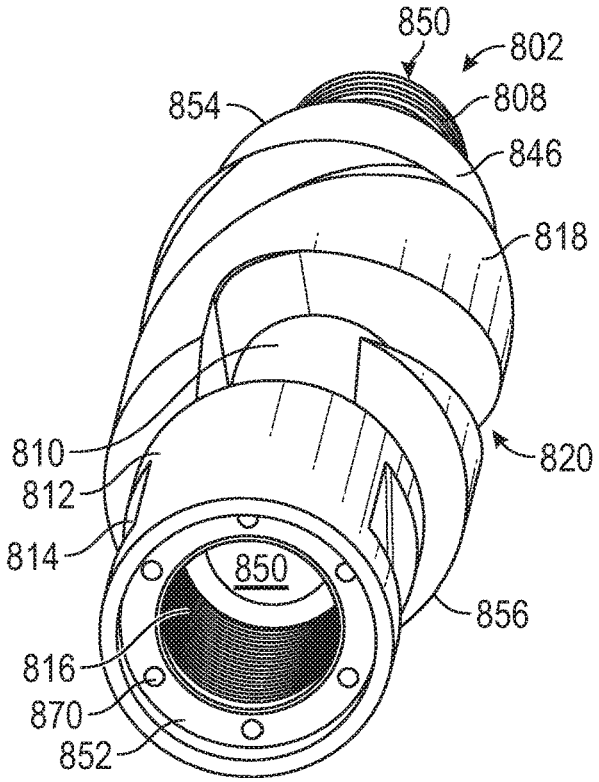
FIG. 36 is a bottom perspective view of an illustrative top portion of the exemplary rod centralizer and solids control assembly of FIG. 33, with the bottom portion being a mirror image thereof.

Referring to FIGS. 34-36, the top portion 802 will be discussed in further detail. The top portion 802 can include a shoulder 846 positioned above the shaft 810. The shaft 810 of the top portion 802 can take on a cylindrical shape and can generally be positioned between the upper threaded region 808 and sleeve 812. The sleeve 812 can include an upper portion 848 and an inlet 850 for receiving an upper portion of a rotating rod 886. The sleeve 812 can include an upper threaded region 816 (as best seen in FIG. 36) configured to mate with an upper threaded region 900 of the rod 886, as discussed further herein. The sleeve 812 can include a pair of wrench flats 814 on opposing sides thereof to facilitate coupling and de-coupling of the top portion 802 to other components of the assembly 800. The sleeve 812 can include a lower non-threaded region 852 configured to mate with an upper region 876 of the top brush retainer 874, as discussed further herein. The sleeve 812 may further include a plurality of synchronizing magnets 870 configured to mate with a plurality of synchronizing magnets 871 on the top brush retainer 874, as discussed further herein.

The top centralizer component 818 can be positioned around an outer portion of the shaft 810. The top centralizer component 818 can generally include an upper portion 854, a lower portion 856, and a center channel 872 running therethrough. The upper portion 854 of the top centralizer component 818 can abut a lower portion 904 of the shoulder 846, while the lower portion 856 of the top centralizer component 818 can abut the upper portion 848 of the sleeve 812. The top centralizer component 818 can be made up of a hardened, heat-treated material, such as carbide, an alloy, plastics, polymers, engineered composite or some other suitable material. Generally, the top centralizer component 818 can have a cylindrical shape and an overall diameter greater than the sleeve 812. In one embodiment, the outer diameter of the top centralizer component 818 can be slightly less than the interior diameter of the tubing. This will help to prevent the assembly 800 from moving from side to side within the tubing. The top centralizer component 818 can include an elongated channel 820. Channel 820 permits the passage of fluid therethrough. In one embodiment, channel 820 may be helical and can spiral around the top centralizer component 818 at various angles. The channel 820 can spiral along the length of the top centralizer component 818.

With respect to the positioning of the top centralizer component 818, in one embodiment the top centralizer component 818 is not permanently affixed to the shaft 810 but, rather, is held in place around the shaft 810 by friction. In this way, the top centralizer component 818 is permitted to float upon the shaft 810. There can be a slight interference fit between the top centralizer component 818 and the shaft 810.

Figure 37:
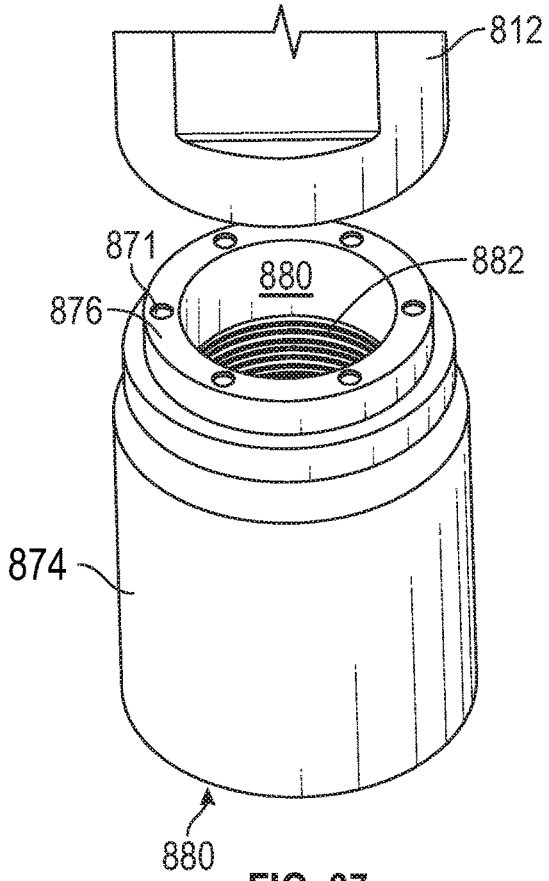
FIG. 37 is a top perspective view of an illustrative top brush retainer of the exemplary rod centralizer and solids control assembly of FIG. 33, with the bottom brush retainer being a mirror image thereof.

Referring to FIGS. 34-35 and 37, the top brush retainer 874 will be discussed in further detail. The top brush retainer 874 can generally include an upper region 876, a lower region 878, and a center channel 880 (as best seen in FIG. 37) running therethrough. The top brush retainer 874 can further include a threaded region 882 configured to mate with an upper threaded region 824 of the brush tube 822, as discussed further herein. The upper region 876 can include a plurality of synchronizing magnets 871 configured to mate with the plurality of synchronizing magnets 870 on the sleeve 812. The lower region 878 can be configured to receive an upper portion of the brush tube 822, as discussed further herein. The center channel 880 is configured to permit an upper portion of the rod 886 to pass therethrough.

Referring now to FIGS. 36-37, the plurality of synchronizing magnets 870 positioned on the lower non-threaded region 852 of the sleeve 812 and the plurality of synchronizing magnets 871 positioned on the upper region 876 of the top brush retainer 874 can be seen. The synchronizing magnets 870 can generally be spaced equidistant from each other, and the synchronizing magnets 871 can generally be spaced equidistant from each other. According to one embodiment, the synchronizing magnets 870 and 871 can each be positioned radially on the sleeve 812 and the top brush retainer 874, respectively, with the synchronizing magnets 870 and the synchronizing magnets 871 facing each other when the top portion 802 and top brush retainer 874 are coupled. Preferably, the synchronizing magnets 870 and 871 are oriented with unlike poles facing each other, so that the exposed surfaces of the synchronizing magnets 870 will be attracted to the exposed surfaces of the synchronizing magnets 871, and vice versa. The number of synchronizing magnets 870 can equal the number of synchronizing magnets 871, such that each synchronizing magnet 870 can mate with a synchronizing magnet 871. In this embodiment, six synchronizing magnets 870 and six synchronizing magnets 871 are provided. However, it should be clearly understood that substantial benefit could be derived from an alternate configuration in which more than six or fewer than six synchronizing magnets 870 and synchronizing magnets 871 are employed, without departing from the spirit or scope of the present disclosure. In another embodiment, instead of utilizing synchronizing magnets 870 and 871, other synchronizing components may be used, including, for example, knurls, teeth, composite material brakes, and the like. The synchronizing magnets 870 and 871 (or other synchronizing component utilized) may be utilized at the top portion 802 and top brush retainer 874 alone, at the bottom portion 806 and bottom brush retainer 888 alone, or at both of these areas. Although not shown, it should be noted that the synchronizing magnets 870 and 871 utilized at the bottom portion 806 and bottom brush retainer 888 would be configured and utilized in the same manner as the synchronizing magnets 870 and 871 utilized at the top portion 802 and top brush retainer 874.

Referring again to FIGS. 34-35, the brush tube 822 will be discussed in further detail. The brush tube 822 can be cylindrical with a center channel 884 running therethrough for the rod 886. In one embodiment, the brush tube 822 can be permitted to float upon the rod 886, such that the brush tube 822 is not permanently affixed to the rod 886. The brush tube 822 can include an upper threaded region 824 such that it can be coupled to the threaded region 882 of the top brush retainer 874. When upper threaded region 824 is coupled to threaded region 882 of the top brush retainer 874, it can be seen that an upper portion of the brush tube 822 including a portion of bristle 828 mates with lower region 878 of the top brush retainer 874. In this way, the top brush retainer 874 is configured to cover a portion of the bristle 828 and hold it in place. The brush tube 822 can include a lower threaded region 826 such that it can be coupled to the threaded region 896 of the bottom brush retainer 888. When lower threaded region 826 is coupled to threaded region 896 of the bottom brush retainer 888, it can be seen that a lower portion of the brush tube 822 including a portion of bristle 828 mates with upper region 890 of the bottom brush retainer 888. In this way, the bottom brush retainer 888 is configured to cover a portion of the bristle 828 and hold it in place. While the upper threaded region 824 and lower threaded region 826 are each shown as comprising male threading, it should be clearly understood that substantial benefit could be derived from an alternate configuration of the upper threaded region 824, lower threaded region 826, or both, in which female threading is employed, without departing from the spirit and scope of the present disclosure, so long as upper threaded region 824 and lower threaded region 826 are capable of mating with corresponding top brush retainer 874 and bottom brush retainer 888, respectively. A helical groove 830 can be formed on the brush tube 822. The helical groove 830 can spiral around the brush tube 822 at various angles, for example, thirty degrees. The helical groove 830 can spiral along the length of the brush tube 822. These spirals can create sections between the grooves 830.

Referring still to FIGS. 34-35, the bristle 828 will be discussed in further detail. The bristle 828 can have a spiral shape and conform to the groove 830 of the brush tube 822. The bristle 828, in one embodiment, can be helical and spiral around the groove 830 of the assembly 800. The bristle 828 can be configured at different angles, for example, at thirty degrees. The bristle 828 can be made of a wide variety of materials. These materials can include, but are not limited to, steel, plastic, high temperature nylon, polymer, etc. and can depend on conditions of the pump. Generally, the bristle 828 can extend between the top portion 804 and the bottom portion 806 and, more specifically, the bristle 828 can extend between the top brush retainer 874 and the bottom brush retainer 888. The bristles 828 can generally be spaced equidistant from each other.

Referring still to FIGS. 34-35, the rotating rod 886 will be discussed in further detail. The rod 886 can have a long cylindrical shape and generally, a diameter less than the top portion 802, top brush retainer 874, body portion 804, bottom brush retainer 888, and bottom portion 806. The rod 886 can include an upper threaded region 900 and a lower threaded region 902 that are configured to securely couple the rod 886 in place within the assembly 800. In this regard, in one embodiment, upper threaded region 900 can be coupled to the upper threaded region 816 of the sleeve 812, while lower threaded region 902 can be coupled to a lower threaded region 836 of the sleeve 832. According to one embodiment, upper threaded region 900 and lower threaded region 902 can each comprise a sucker rod pin thread or the like.

Referring still to FIGS. 34-35, the bottom brush retainer 888 will be discussed in further detail. The bottom brush retainer 888 can generally include an upper region 890, a lower region 892, and a center channel 894 running therethrough. The bottom brush retainer 888 can further include a threaded region 896 configured to mate with the lower threaded region 826 of the brush tube 822. The lower region 892 can include a plurality of synchronizing magnets 871 configured to mate with a plurality of synchronizing magnets 870 on the sleeve 832. The upper region 890 can be configured to receive a lower portion of the brush tube 822. The center channel 894 is configured to permit a lower portion of the rod 886 to pass therethrough.

Referring still to FIGS. 34-35, the bottom portion 806 will be discussed in further detail. The bottom portion 806 can include a shoulder 864 positioned below the shaft 838. The shaft 838 of the bottom portion 806 can take on a cylindrical shape and can generally be positioned between the lower threaded region 840 and sleeve 832. The sleeve 832 can include a lower portion 862 and an inlet 860 for receiving a lower portion of the rotating rod 886. The sleeve 832 can include a lower threaded region 836 configured to mate with the lower threaded region 902 of the rod 886. The sleeve 832 can include a pair of wrench flats 834 on opposing sides thereof facilitate coupling and de-coupling of the bottom portion 806 to other components of the assembly 800. The sleeve 832 can include an upper non-threaded region 858 configured to mate with the lower region 892 of the bottom brush retainer 888. The sleeve 832 may further include a plurality of synchronizing magnets 870 configured to mate with the plurality of synchronizing magnets 871 on the bottom brush retainer 888, as discussed above.

The bottom centralizer component 842 can be positioned around an outer portion of the shaft 838. The bottom centralizer component 842 can generally include an upper portion 866, a lower portion 868, and a center channel 898 running therethrough. The lower portion 868 of the bottom centralizer component 842 can abut an upper portion 906 of the shoulder 864, while the upper portion 866 of the bottom centralizer component 842 can abut the lower portion 862 of the sleeve 832. The bottom centralizer component 842 can be made up of a hardened, heat-treated material, such as carbide, an alloy, plastics, polymers, engineered composite or some other suitable material. Generally, the bottom centralizer component 842 can have a cylindrical shape and an overall diameter greater than the sleeve 832. In one embodiment, the outer diameter of the bottom centralizer component 842 can be slightly less than the interior diameter of the tubing. This will help to prevent the assembly 800 from moving from side to side within the tubing. The bottom centralizer component 842 can include an elongated channel 844. Channel 844 permits the passage of fluid therethrough. In one embodiment, channel 844 may be helical and can spiral around the bottom centralizer component 842 at various angles. The channel 844 can spiral along the length of the bottom centralizer component 842.

With respect to the positioning of the bottom centralizer component 842, in one embodiment the bottom centralizer component 842 is not permanently affixed to the shaft 838 but, rather, is held in place around the shaft 838 by friction. In this way, the bottom centralizer component 842 is permitted to float upon the shaft 838. There can be a slight interference fit between the bottom centralizer component 842 and the shaft 838.

Figure 38:
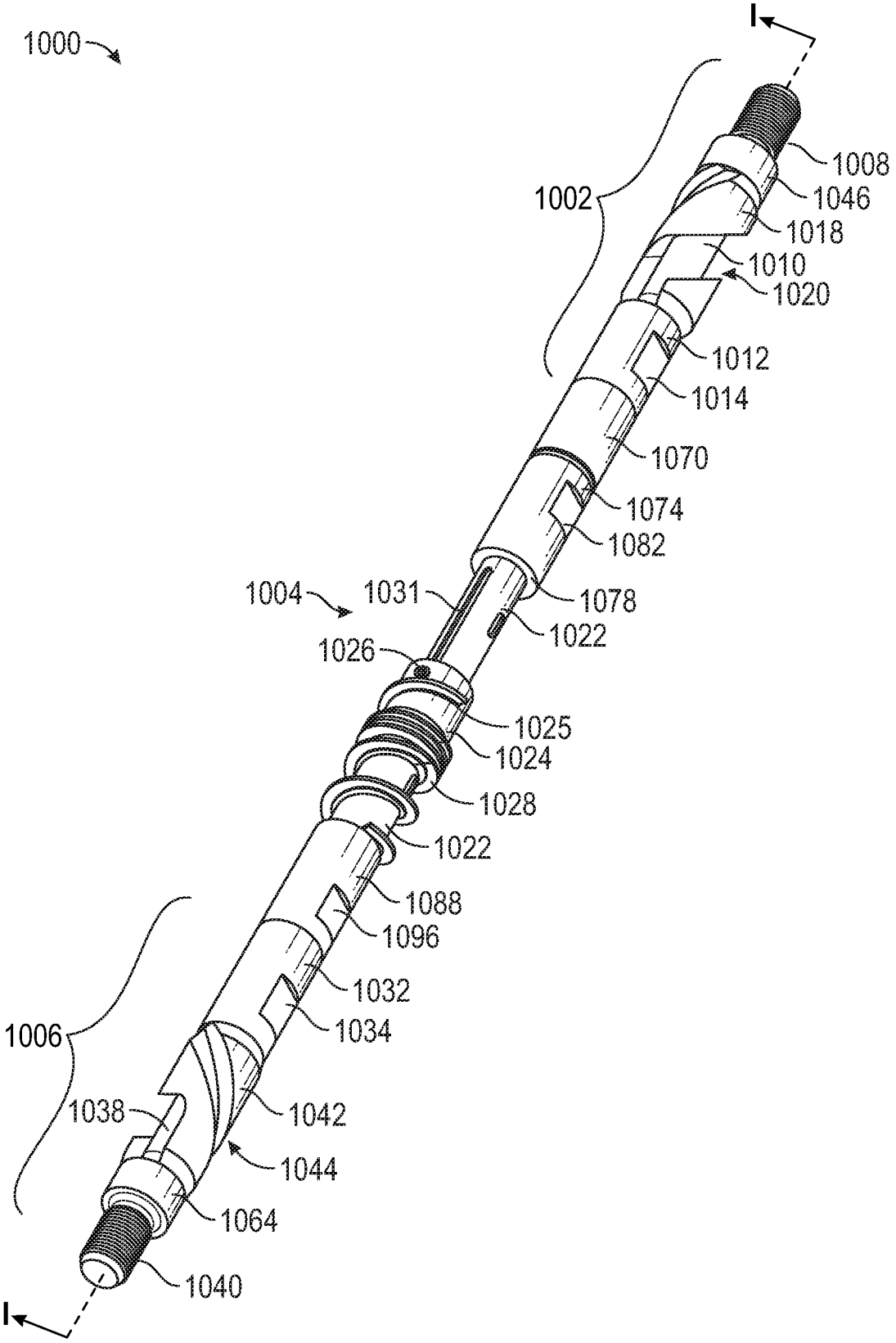
FIG. 38 is a perspective view of another embodiment of an exemplary rod centralizer and solids control assembly in accordance with one aspect of the present disclosure.

FIGS. 38-46 show another embodiment of a rod centralizer and solids control assembly, hereinafter rod centralizer and solids control assembly 1000. Turning now to FIG. 38, a perspective view of an exemplary rod centralizer and solids control assembly 1000 in accordance with one aspect of the present disclosure is provided. Portions of the assembly 1000 can be made up of a hardened material, such as carbide, an alloy, plastics, polymers, engineered composite or some other suitable material commonly found within such assemblies 1000. The rod centralizer and solids control assembly 1000 can generally include a top portion 1002 and a bottom portion 1006 with a body portion 1004 therebetween. Further, the rod centralizer and solids control assembly 1000 can include a top brush retainer with clutch 1074 interposed between the top portion 1002 and body portion 1004, and a bottom brush retainer 1088 interposed between the bottom portion 1006 and body portion 1004. In this embodiment, the assembly 1000 can have a substantially longitudinal shape and include a one-piece structure incorporating the top portion 1002, body portion 1004, bottom portion 1006, top brush retainer with clutch 1074, and bottom brush retainer 1088.

The bottom portion 1006 can have an overall diameter equal to that of the top portion 1002, while the body portion 1004 generally has a diameter that is smaller than both. Further, the bottom brush retainer 1088 can have an overall diameter equal to that of the top brush retainer with clutch 1074, while the body portion 1004 generally has a diameter that is smaller than both. The body portion 1004 can have a bristle 1028. The diameter of the body portion 1004 along with the bristle 1028 can be greater than a diameter of the top portion 1002, bottom portion 1006, top brush retainer with clutch 1074, and bottom brush retainer 1088.

The bottom portion 1006 can include a lower threaded region 1040 such that it can be coupled to a rod string. This configuration permits the bottom portion 1006 of the assembly 1000 to be fastened directly into the rod string without the need for any connector components. According to one embodiment, lower threaded region 1040 can comprise an API one-inch sucker rod pin thread or the like. While the lower threaded region 1040 is shown as comprising male threading, it should be clearly understood that substantial benefit could be derived from an alternate configuration of the lower threaded region 1040 in which female threading is employed, without departing from the spirit or scope of the present disclosure.

Furthermore, the top portion 1002 can include an upper threaded region 1008 such that it can be coupled to a rod string. This configuration permits the top portion 1002 of the assembly 1000 to be fastened directly into the rod string without the need for any connector components. According to one embodiment, upper threaded region 1008 can comprise an API one-inch sucker rod pin thread or the like. While the upper threaded region 1008 is shown as comprising male threading, it should be clearly understood that substantial benefit could be derived from an alternate configuration of the upper threaded region 1008 in which female threading is employed, without departing from the spirit or scope of the present disclosure.

Figure 39:
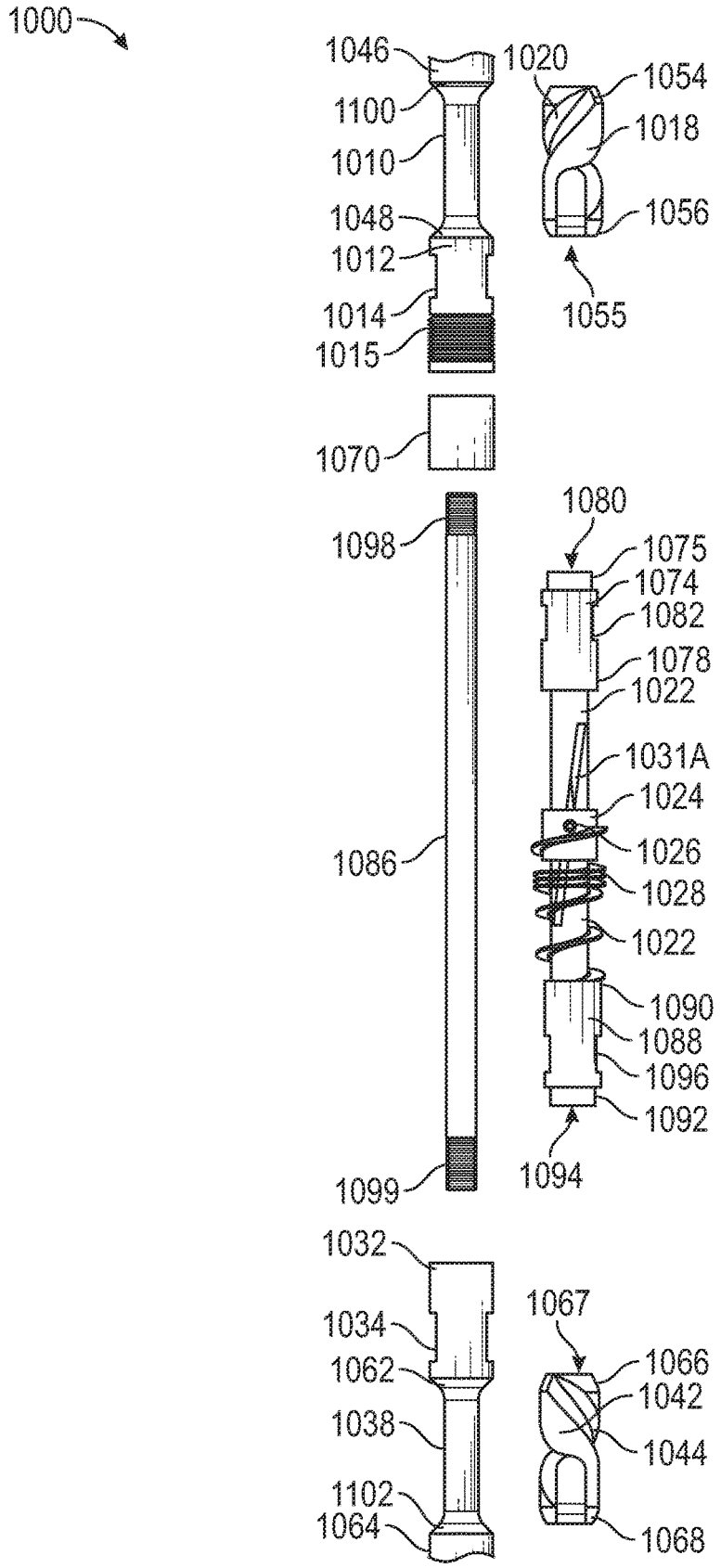
FIG. 39 is a side, partially exploded view of an exemplary rod centralizer and solids control assembly in accordance with one aspect of the present disclosure.
Figure 40:
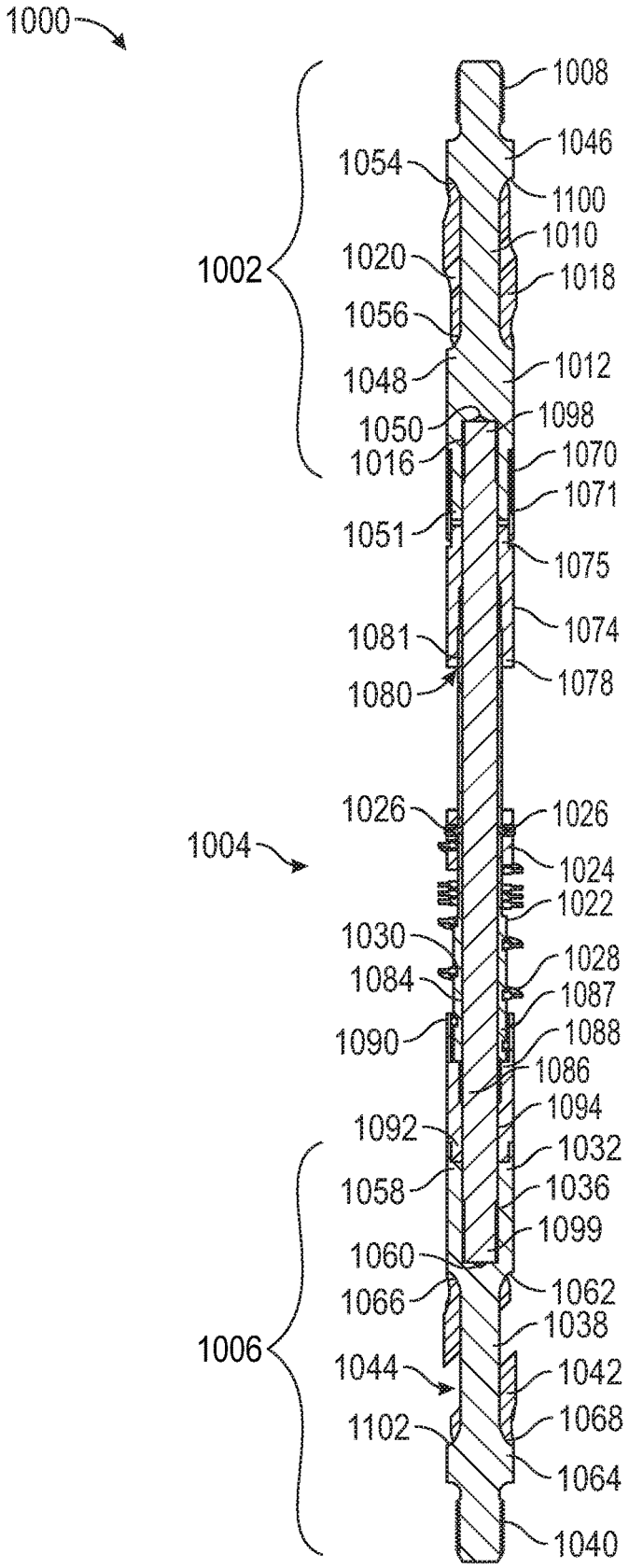
FIG. 40 is a cross-sectional view of the exemplary rod centralizer and solids control assembly of FIG. 38 along line I-I.

Referring now to FIGS. 38-40, in addition to the top portion 1002, top brush retainer with clutch 1074, bottom portion 1006, and bottom brush retainer 1088, the assembly 1000 can generally include a brush tube 1022, a bristle 1028, and a piston 1024. The top portion 1002 can include a shaft 1010 and a sleeve with clutch 1012. A lower portion of the sleeve with clutch 1012 can be covered by a clutch cover coupling 1070. A top centralizer component 1018 can be positioned around the shaft 1010. The bottom portion 1006 can include a shaft 1038 and a sleeve 1032. A bottom centralizer component 1042 can be positioned around the shaft 1038. Those skilled in the relevant art will appreciate that various combinations of these elements, as well as fewer or additional components, can be added to the assembly 1000.

Figure 41:
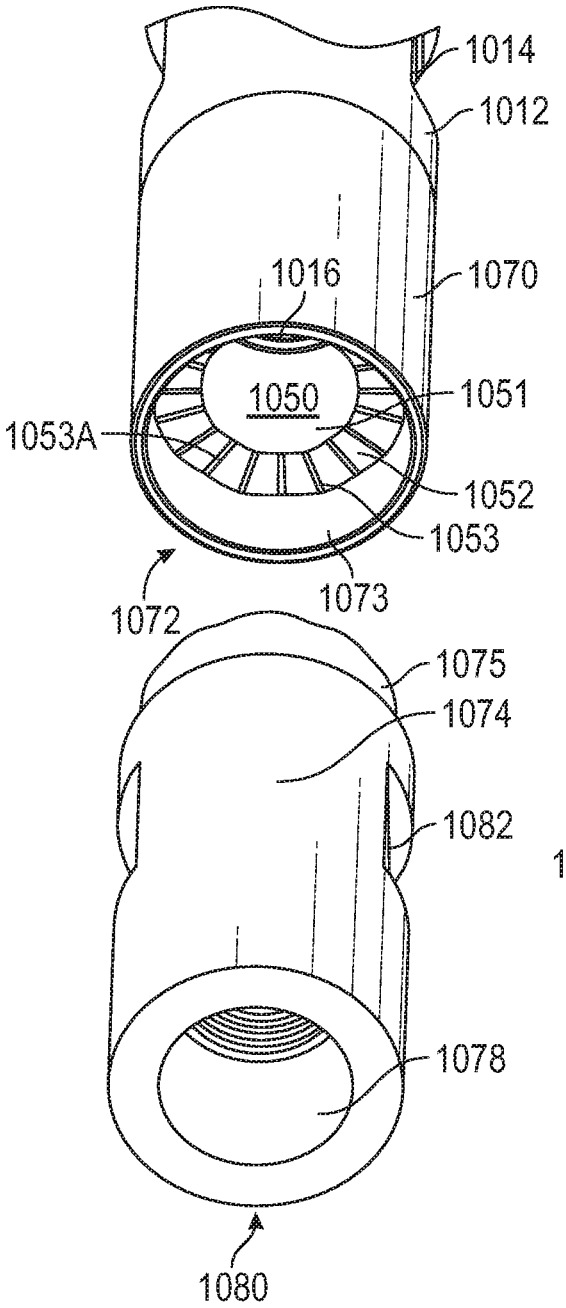
FIG. 41 is a bottom perspective view of an illustrative sleeve with clutch and clutch cover coupling shown detached from an illustrative top brush retainer with clutch of the exemplary rod centralizer and solids control assembly of FIG. 38 in accordance with one aspect of the present disclosure.

Referring still to FIGS. 38-40, the top portion 1002 will be discussed in further detail. The top portion 1002 can include a shoulder 1046 positioned above the shaft 1010. The shaft 1010 of the top portion 1002 can take on a cylindrical shape and can generally be positioned between the upper threaded region 1008 and sleeve with clutch 1012. The sleeve with clutch 1012 can include an upper portion 1048 and an inlet 1050 for receiving an upper portion of a rotating rod 1086. The sleeve with clutch 1012 can include an upper threaded region 1016 (as shown in FIGS. 40 and 41) configured to mate with an upper threaded region 1098 of the rod 1086, as discussed further herein. The sleeve with clutch 1012 can include a pair of wrench flats 1014 on opposing sides thereof to facilitate coupling and de-coupling of the top portion 1002 to other components of the assembly 1000. The sleeve with clutch 1012 can include an exterior threaded region 1015 proximate a lower end thereof that is configured to mate with an interior threaded region 1071 of the clutch cover coupling 1070, as discussed further herein. The sleeve with clutch 1012 can include a lower non-threaded region 1051.

The sleeve with clutch 1012 can work in tandem with the top brush retainer with clutch 1074 as a clutch system. Thus, the sleeve with clutch 1012 may further include a lower end having a plurality of clutching surfaces 1052, projecting regions 1053, and recessed regions 1053A (see FIG. 41) configured to mate with an upper end of the top brush retainer with clutch 1074, as discussed further herein.

The top centralizer component 1018 can be positioned around an outer portion of the shaft 1010. The top centralizer component 1018 can take on a generally hollow cylindrical shape and can generally include an upper portion 1054, a lower portion 1056, and a center channel 1055 running therethrough. The upper portion 1054 of the top centralizer component 1018 can abut a lower portion 1100 of the shoulder 1046, while the lower portion 1056 of the top centralizer component 1018 can abut the upper portion 1048 of the sleeve with clutch 1012. The top centralizer component 1018 can be made up of a hardened, heat-treated material, such as carbide, an alloy, plastics, polymers, engineered composite or some other suitable material. Generally, the top centralizer component 1018 can have an overall diameter greater than the sleeve 1012. In one embodiment, the outer diameter of the top centralizer component 1018 can be slightly less than the interior diameter of the tubing. This will help to prevent the assembly 1000 from moving from side to side within the tubing. The top centralizer component 1018 can include an elongated channel 1020. Channel 1020 permits the passage of fluid therethrough. In one embodiment, channel 1020 may be helical and can spiral around the top centralizer component 1018 at various angles. The channel 1020 can spiral along the length of the top centralizer component 1018.

With respect to the positioning of the top centralizer component 1018, in one embodiment the top centralizer component 1018 is not permanently affixed to the shaft 1010 but, rather, is held in place around the shaft 1010 by friction. In this way, the top centralizer component 1018 is permitted to float upon the shaft 1010. There can be a slight interference fit between the top centralizer component 1018 and the shaft 1010.

Referring now to FIGS. 38-42, the clutch cover coupling 1070 will be discussed in further detail. The clutch cover coupling 1070 can generally comprise a hollow cylindrical shape with a center channel 1072 (see FIG. 41) running therethrough. The clutch cover coupling 1070 can include an interior threaded region 1071 (see FIG. 40) that is configured to mate with the exterior threaded region 1015 of the sleeve with clutch 1012 so that the clutch cover coupling 1070 and sleeve with clutch 1012 can be coupled together. The clutch cover coupling 1070 can include a lower interior surface 1073 (see FIG. 41) that is configured to mate with an upper region 1075 of the top brush retainer with clutch 1074, as discussed further herein.

Figure 42:
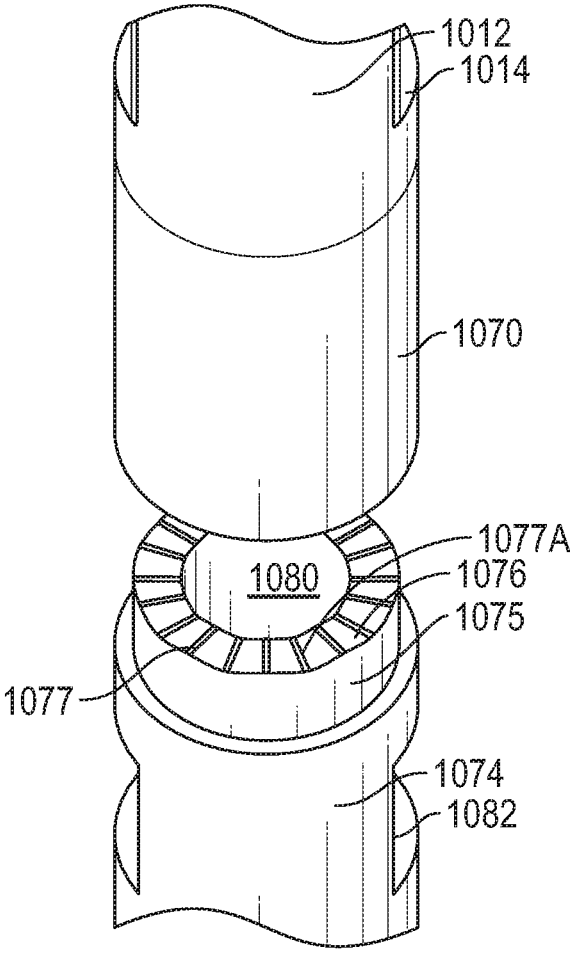
FIG. 42 is a top perspective view of the illustrative sleeve with clutch and clutch cover coupling shown detached from the illustrative top brush retainer with clutch of FIG. 41.

Referring still to FIGS. 38-42, the top brush retainer with clutch 1074 will be discussed in further detail. The top brush retainer with clutch 1074 can generally include an upper region 1075, a lower region 1078, and a center channel 1080 (as shown in FIGS. 40 and 41) running therethrough. The top brush retainer with clutch 1074 can further include a pair of wrench flats 1082 on opposing sides thereof to facilitate coupling and de-coupling of the top brush retainer with clutch 1074 to other components of the assembly 1000. With reference to FIG. 42, the top brush retainer with clutch 1074 may further include an upper end having a plurality of clutching surfaces 1076, projecting regions 1077, and recessed regions 1077A configured to mate with the clutching surfaces 1052, recessed regions 1053A, and projecting regions 1053, respectively, on the lower end of the sleeve with clutch 1012, as discussed further herein. The lower region 1078 can be configured to receive an upper portion of the brush tube 1022, as discussed further herein. The center channel 1080 is configured to permit an upper portion of the rod 1086 to pass therethrough.

Referring now to FIGS. 41-42, the plurality of clutching surfaces 1052, projecting regions 1053, and recessed regions 1053A positioned on the lower end of the sleeve with clutch 1012 (see FIG. 41) and the plurality of clutching surfaces 1076, projecting regions 1077, and recessed regions 1077A positioned on the upper end of the top brush retainer with clutch 1074 (see FIG. 42) can be seen. Turning first to FIG. 41, each clutching surface 1052 can be angled, with a first, lower portion of each clutching surface 1052 positioned adjacent to each projecting region 1053 and a second, upper portion of each clutching surface 1052 positioned adjacent to each recessed region 1053A. With this configuration, each projecting region 1053 is downward-facing and positioned lower relative to each recessed region 1053A, while each recessed region 1053A is upward-facing and positioned higher relative to each projecting region 1053. Referring now to FIG. 42, each clutching surface 1076 can be angled, with a first, upper portion of each clutching surface 1076 positioned adjacent to each projecting region 1077 and a second, lower portion of each clutching surface 1076 positioned adjacent to each recessed region 1077A. With this configuration, each projecting region 1077 is upward-facing and positioned higher relative to each recessed region 1077A, while each recessed region 1077A is downward-facing and positioned lower relative to each projecting region 1077. According to one embodiment, the clutching surfaces 1052, projecting regions 1053, and recessed regions 1053A can each be positioned radially on the lower end of the sleeve with clutch 1012. Similarly, the clutching surfaces 1076, projecting regions 1077, and recessed region 1077A can each be positioned radially on the upper end of the top brush retainer with clutch 1074. The clutching surfaces 1052, projecting regions 1053, and recessed regions 1053A, and the clutching surfaces 1076, recessed regions 1077A, and projecting regions 1077, respectively, are configured to engage with each other, as discussed further herein.

Referring now to FIGS. 38-40 and 43, the brush tube 1022 will be discussed in further detail. The brush tube 1022 can be cylindrical with a center channel 1084 running therethrough for the rod 1086. In one embodiment, the brush tube 1022 can be permitted to float upon the rod 1086, such that the brush tube 1022 is not permanently affixed to the rod 1086. The brush tube 1022 can include an upper region 1081 configured to mate with the lower region 1078 of the top brush retainer with clutch 1074 (see FIG. 40). The brush tube 1022 can include a lower region 1087 configured to mate with the upper region 1090 of the bottom brush retainer 1088. When lower region 1087 is mated with upper region 1090 of the bottom brush retainer 1088, it can be seen that a lower portion of the brush tube 1022 including a portion of bristle 1028 mates with upper region 1090 of the bottom brush retainer 1088. In this way, the bottom brush retainer 1088 is configured to cover a portion of the bristle 1028 and hold it in place. A helical groove 1030 can be formed on the brush tube 1022. The helical groove 1030 can spiral around the brush tube 1022 at various angles, for example, thirty degrees. The helical groove 1030 can spiral along a lower portion of the brush tube 1022. These spirals can create sections between the grooves 1030.

Figure 43:
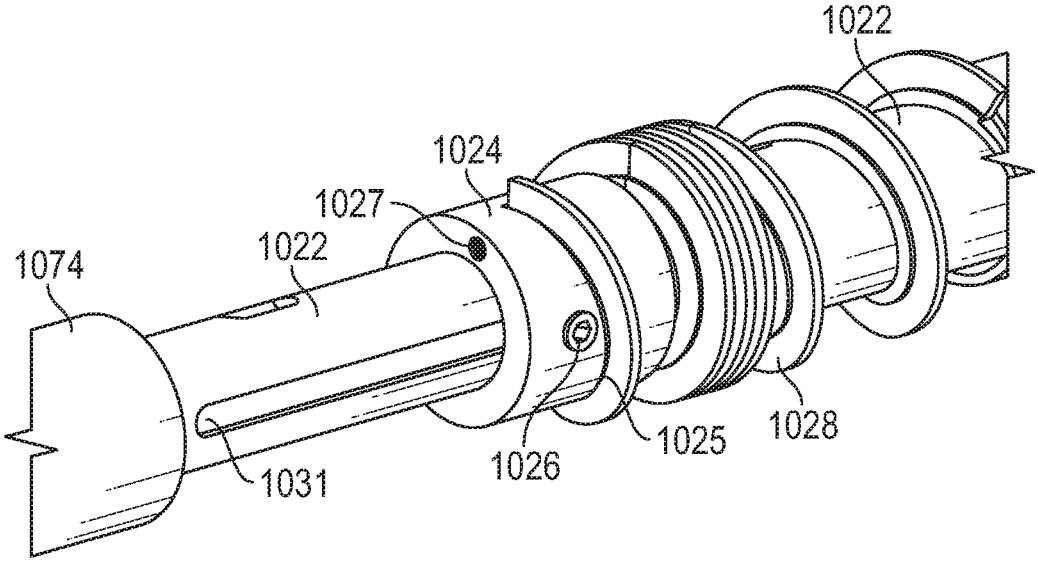
FIG. 43 is a perspective view of a portion of an illustrative body portion of the exemplary rod centralizer and solids control assembly of FIG. 38.

A slot 1031 can be formed on the brush tube 1022. Referring to FIGS. 38 and 43, in one embodiment, slot 1031 can have a straight configuration extending along a length of the brush tube 1022. Referring to FIG. 39, another embodiment of slot 1031 (hereinafter slot 1031A), is shown. Slot 1031A can have a curved or spiraled configuration extending along a length of the brush tube. Slots 1031 and 1031A are each configured to receive a portion of a set screw 1026 therein, which may ride in the slots 1031 and 1031A and permit extension and retraction of the bristle 1028, as discussed further herein. With this configuration, the bristle 1028 can extend and retract as the set screw 1026 rides in the slot 1031 or 1031A and the piston 1024 travels upward and downward along the brush tube 1022, without the bristle 1028 having to rotate independently of the brush tube 1022.

Referring now to FIGS. 38-40 and 43, the outer piston 1024 will be discussed in further detail. The piston 1024 can be configured to be slidably positioned over the brush tube 1022. The piston 1024 can take on a cylindrical shape and can have a center channel to permit the brush tube 1022 to be positioned therethrough. The piston 1024 is configured to slide up and down the brush tube 1022 during pumping operations. In this regard, the piston 1024 can generally be slidably positioned between the top brush retainer with clutch 1074 and bottom brush retainer 1088. A helical groove 1025 can be formed on the piston 1024. The helical groove 1025 is configured to receive an upper portion of the bristle 1028 therein. The helical groove 1025 can spiral around the piston 1024 at various angles, for example, thirty degrees. The piston 1024 can include a set screw 1026 (as shown in FIGS. 38, 39, and 43) positioned on a side of the piston 1024 that is configured to engage and ride in slot 1031 or 1031A. In this way, the set screw 1026 can be configured to be slidably positioned in slot 1031 or 1031A. Set screw 1026 may be button-style or the like. The piston 1024 can include one or more set screws 1027 (see FIG. 43) positioned on an upper end of the piston 1024, a lower end of the piston 1024, or both, that is configured to clamp the bristle 1028 and hold it in place on the piston 1024. This will prevent the bristle 1028 from detaching from the piston 1024 during use.

Figure 44:
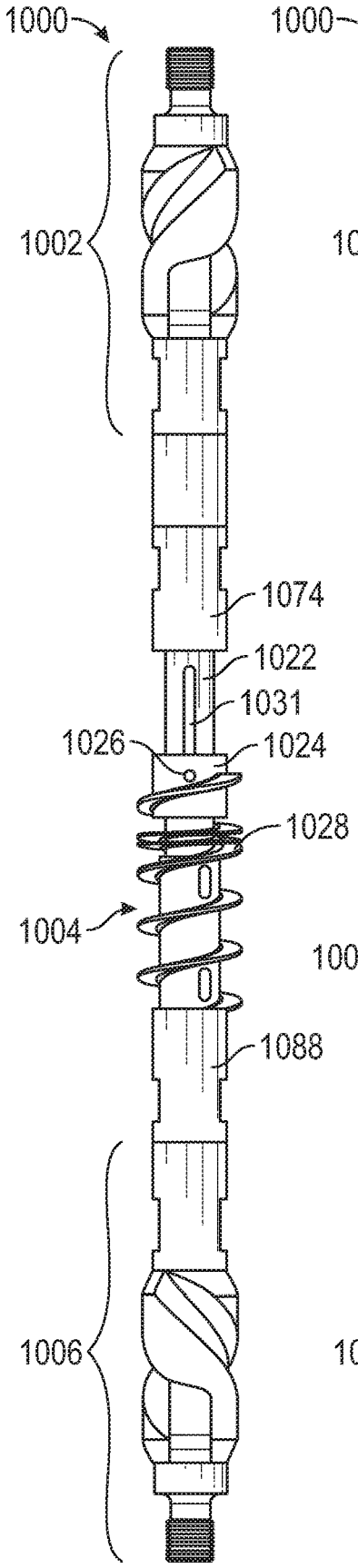
FIG. 44 is a side view of an exemplary rod centralizer and solids control assembly, illustrating the positioning of a bristle thereof in a first orientation, in accordance with one aspect of the present disclosure.
Figure 45:
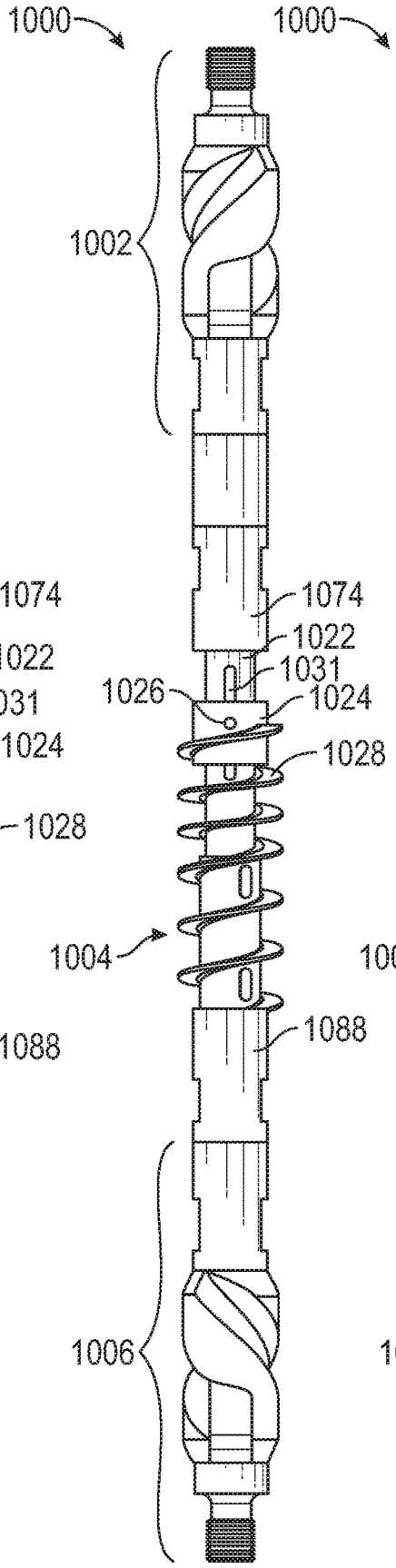
FIG. 45 is a side view of an exemplary rod centralizer and solids control assembly, illustrating the positioning of a bristle thereof in a second orientation, in accordance with one aspect of the present disclosure.
Figure 46:
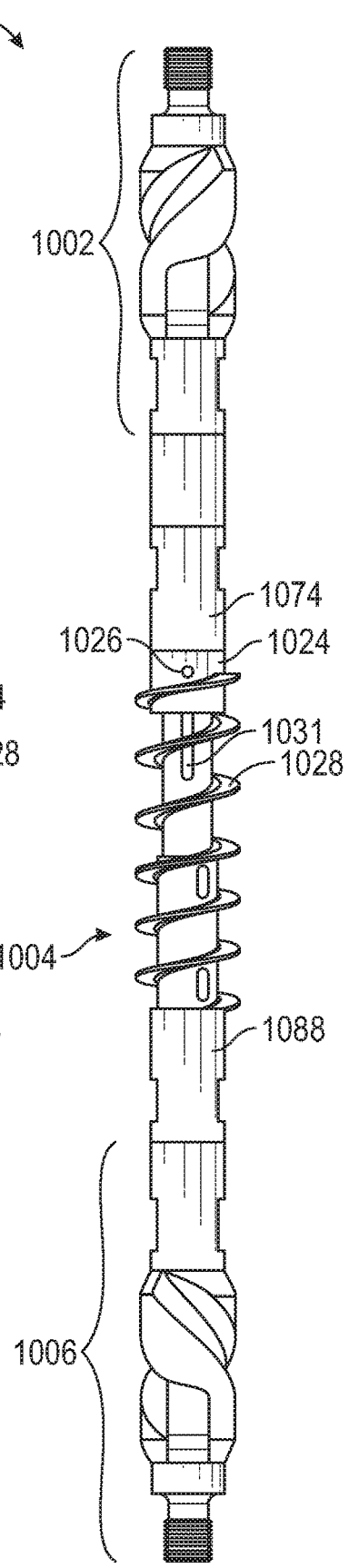
FIG. 46 is a side view of an exemplary rod centralizer and solids control assembly, illustrating the positioning of a bristle thereof in a third orientation, in accordance with one aspect of the present disclosure.

Referring now to FIGS. 38-40 and 43, the bristle 1028 will be discussed in further detail. The bristle 1028 can have a spiral shape and conform to the groove 1030 of the brush tube 1022. Similarly, a portion of the bristle 1028 that is positioned on the outer piston 1024 can conform to the groove 1025 of the outer piston 1024. An upper portion of the bristle 1028 can be coupled to the piston 1024. The bristle 1028, in one embodiment, can be helical and spiral around the groove 1030 of the assembly 1000. The bristle 1028 can further spiral around the groove 1025. The bristle 1028 can be configured at different angles, for example, at thirty degrees. The bristle 1028 can be made of a wide variety of materials. These materials can include, but are not limited to, steel, plastic, high temperature nylon, polymer, etc. and can depend on conditions of the pump. Generally, the bristle 1028 is configured to alternately extend and retract between the bottom portion 1006 and the top portion 1002. More specifically, the bristle 1028 can extend and retract between the bottom brush retainer 1088 and top brush retainer with clutch 1074, with the extension and retraction of the bristle 1028 controlled by the movement of the outer piston 1024. When in a retracted position (as shown in FIGS. 38-40 and 43-44), a lower portion of the bristles 1028 can generally be spaced equidistant from each other, while an upper portion of the bristles 1028 can generally be collapsed upon each other. When in a partially extended position (as shown in FIG. 45), a lower portion of the bristles 1028 can generally be spaced equidistant from each other, while an upper portion of the bristles 1028 can also generally be spaced equidistant from each other. When in a fully extended position (as shown in FIG. 46), the bristles 1028 can generally be spaced equidistant from each other.

Referring now to FIGS. 39-40, the rotating rod 1086 will be discussed in further detail. The rod 1086 can have a long cylindrical shape and, generally, a diameter less than the top portion 1002, top brush retainer with clutch 1074, body portion 1004, bottom brush retainer 1088, and bottom portion 1006. In one embodiment, the rod 1086 can include an upper threaded region 1098 and a lower threaded region 1099 that are configured to securely couple the rod 1086 in place within the assembly 1000. In this regard, in one embodiment, upper threaded region 1098 can be coupled to the upper threaded region 1016 of the sleeve with clutch 1012, while lower threaded region 1099 can be coupled to a lower threaded region 1036 of the sleeve 1032. According to one embodiment, upper threaded region 1098 and lower threaded region 1099 can each comprise a sucker rod pin thread or the like. According to another embodiment, the rod 1086 can be secured in place within the assembly 1000 via a shrink fit assembly or the like.

Referring now to FIGS. 38-40, the bottom brush retainer 1088 will be discussed in further detail. The bottom brush retainer 1088 can generally include an upper region 1090, a lower region 1092, and a center channel 1094 (as shown in FIGS. 39 and 40) running therethrough. The bottom brush retainer 1088 can further include a pair of wrench flats 1096 on opposing sides thereof to facilitate coupling and de-coupling of the bottom brush retainer 1088 to other components of the assembly 1000. The upper region 1090 can be configured to receive a lower portion of the brush tube 1022. As discussed above, when lower region 1087 of the brush tube 1022 is mated with upper region 1090 of the bottom brush retainer 1088, it can be seen that a lower portion of the brush tube 1022 including a portion of bristle 1028 mates with upper region 1090 of the bottom brush retainer 1088. In this way, the bottom brush retainer 1088 is configured to cover a portion of the bristle 1028 and hold it in place. The center channel 1094 is configured to permit a lower portion of the rod 1086 to pass therethrough.

Referring still to FIGS. 38-40, the bottom portion 1006 will be discussed in further detail. The bottom portion 1006 can include a shoulder 1064 positioned below the shaft 1038. The shaft 1038 of the bottom portion 1006 can take on a cylindrical shape and can generally be positioned between the lower threaded region 1040 and sleeve 1032. The sleeve 1032 can include a lower portion 1062 and an inlet 1060 for receiving a lower portion of the rod 1086. The sleeve 1032 can include a lower threaded region 1036 (as shown in FIG. 40) configured to mate with the lower threaded region 1099 of the rod 1086, as discussed above. The sleeve 1032 can include a pair of wrench flats 1034 on opposing sides thereof facilitate coupling and de-coupling of the bottom portion 1006 to other components of the assembly 1000. The sleeve 1032 can include an upper non-threaded region 1058 configured to mate with the lower region 1092 of the bottom brush retainer 1088.

The bottom centralizer component 1042 can be positioned around an outer portion of the shaft 1038. The bottom centralizer component 1042 can take on a generally hollow cylindrical shape and can generally include an upper portion 1066, a lower portion 1068, and a center channel 1067 running therethrough. The lower portion 1068 of the bottom centralizer component 1042 can abut an upper portion 1102 of the shoulder 1064, while the upper portion 1066 of the bottom centralizer component 1042 can abut the lower portion 1062 of the sleeve 1032. The bottom centralizer component 1042 can be made up of a hardened, heat-treated material, such as carbide, an alloy, plastics, polymers, engineered composite or some other suitable material. Generally, the bottom centralizer component 1042 can have an overall diameter greater than the sleeve 1032. In one embodiment, the outer diameter of the bottom centralizer component 1042 can be slightly less than the interior diameter of the tubing. This will help to prevent the assembly 1000 from moving from side to side within the tubing. The bottom centralizer component 1042 can include an elongated channel 1044. Channel 1044 permits the passage of fluid therethrough. In one embodiment, channel 1044 may be helical and can spiral around the bottom centralizer component 1042 at various angles. The channel 1044 can spiral along the length of the bottom centralizer component 1042.

With respect to the positioning of the bottom centralizer component 1042, in one embodiment the bottom centralizer component 1042 is not permanently affixed to the shaft 1038 but, rather, is held in place around the shaft 1038 by friction. In this way, the bottom centralizer component 1042 is permitted to float upon the shaft 1038. There can be a slight interference fit between the bottom centralizer component 1042 and the shaft 1038.

The various embodiments of the rod centralizer and solids control assembly, including assemblies 100, 700, 800, and 1000, can be comprised of a number of individual, separable components which, when fully assembled, can form a one-piece assembly. With respect to the rod centralizer and solids control assembly 100, this can include the end cap with clutch 206, end cap 208, brush retainer with clutch 210, brush retainer 212, bottom centralizer component 216, top centralizer component 218, rod 202, brush tube 204, and bristle 214. With respect to the rod centralizer and solids control assembly 700, this can include the top portion 702, top centralizer component 718, brush tube 722, bristle 728, bottom portion 706, and bottom centralizer component 742. With respect to the rod centralizer and solids control assembly 800, this can include the top portion 802, top centralizer component 818, synchronizing magnets 870, top brush retainer 874, synchronizing magnets 871, brush tube 822, bristle 828, rod 886, bottom brush retainer 888, bottom portion 806, and bottom centralizer component 842. With respect to the rod centralizer and solids control assembly 1000, this can include the top portion 1002, top centralizer component 1018, clutch cover coupling 1070, top brush retainer with clutch 1074, brush tube 1022, outer piston 1024, bristle 1028, rod 1086, bottom brush retainer 1088, bottom portion 1006, and bottom centralizer component 1042. With the assemblies 100, 700, 800, and 1000 being comprised of multiple individual components, such designs may provide one or more advantages. For example, each of the individual components of the rod centralizer and solids control assemblies 100, 700, 800, and 1000 can be replaced with new components when they are no longer efficient as a result of wear and use, without having to replace the entire rod centralizer and solids control assemblies 100, 700, 800, or 1000.

Operation

In operation, a pumping unit can create a rotational pumping action on the rod centralizer and solids control assembly 100, 700, 800, or 1000. This action can move the oil or other substance being pumped out of the ground and into a flow line, from which the oil can then be taken to a storage tank or other such structure. The assembly 100, 700, 800, or 1000 can be placed within tubing defining a shaft of the pump. The assembly 100, 700, 800, or 1000 can be coupled to a rod string, which can be a string of rotational drive rods. In one embodiment, the assembly 100, 700, 800, or 1000 can be a rod centralizer and placed away from the pump in an upper first joint of the rod just upward from the pump inside the tubing.

Through the pumping unit, the assembly 100, 700, 800, or 1000 creates rotational movement. In each embodiment, the bristles (214, 728, 828, or 1028) coupled to the brush tube (204, 722, 822, or 1022) of the body portion (104, 704, 804, or 1004) can prevent the rod from rubbing against the steel tubing. In essence, the bristles (214, 728, 828, or 1028) can act as a rod centralizer. Furthermore, the top centralizer components (216, 718, 818, or 1018) and bottom centralizer components (218, 742, 842, or 1042) can act as rod centralizers, centering the rod and preventing it from rubbing against the steel tubing.

While one assembly 100, 700, 800, or 1000 can be used, those skilled in the relevant art will appreciate that more than one assembly 100, 700, 800, or 1000 can also be provided within the pumping unit. Thus, multiple assemblies 100, 700, 800, or 1000 can be installed within the pumping unit, and can be spaced-apart in multiple elevations down through the rod string. Such installation can include placing multiple assemblies 100, 700, 800, or 1000 proximate multiple joints of the rod string. In this way, smaller volumes of solids may be captured and prevented from accumulating in the lower joints of the tubing, thereby preventing the rods from seizing. In one embodiment, the assembly 100, 700, 800, or 1000 can be positioned upwardly within the rod string as high as the solids height history of the well in which it is employed. This helps to eliminate situations in which over-torque and/or pump damage concerns may arise due to the presence of solids in the future.

Further features of the bristles 214, 728, and 828 of the rod centralizer and solids control assemblies 100, 700, and 800, respectively, will now be discussed. On a non-rotation of the rod centralizer and solids control assembly 100, 700, or 800, the helical bristle (214, 728, or 828) can lock in place. In one embodiment, the bristle 214, 728, or 828) along with the brush tube (204, 722, or 822) can be held in place. By locking the bristle (214, 728, or 828), solids can be lifted that are in the fluid. The bristles (214, 728, or 828) can trap the solids and hold them away from the pump. This stops the solids from migrating into various areas of the pump assembly and prevents the solids from settling back into the area of the pump stator.

During rod rotation or upward fluid movement in the assembly 100, 700, or 800, the bristle (214, 728, or 828) can unlock and rotate, allowing it to corkscrew itself through the volume of fluid. The bristle (214, 728, or 828) along with the brush tube (204, 722, or 822) can rotate on the rod rotation. This action can leave the solids that it had collected behind high in the tubing away from the pump intake. When the pump rotor stops in the pump, there can be fluid back flow. The well fluid solids can concentrate just outside the pump intake and gradually become less concentrated further up the tubing.

The helical corkscrew action of the free-wheeling motion of the bristle (214, 728, or 828) generally does not allow rod stacking or fluid restriction since there is no resistance to the bristle (214, 728, or 828) or interference in the turning. Further, the bristle (214, 728, or 828) is designed to be flexible in its helical arrangement and will collapse upon starting the pump, with solids being held within the bristle (214, 728, or 828). This helps to prevent the rods from becoming over-torqued, which would result in well shut-down. When the bristle (214, 728, or 828) is fixed on the rotation of the rods, the rods can force the bristle (214, 728, or 828) through the fluid causing great resistance. This action can restrict the rods causing the rods to be forced in the tubing wall causing damage to both the rod and the tubing.

Further features of the bristle 1028 of the rod centralizer and solids control assembly 1000 will now be further discussed. On a non-rotation of the rod centralizer and solids control assembly 1000, various components of the assembly 1000 can be positioned in a first orientation. At this time, the set screw 1026 of the piston 1024 will be positioned at a lowest portion of the slot 1031 or 1031A, with the helical bristle 1028 in a retracted or collapsed state (as shown in FIG. 44). At this time, the fluid in the well will be in a static state. With the well fluid in a static state, there will be no upward pressure on the bristle 1028, allowing the bristle 1028 to naturally collapse and be held in place. With the bristle 1028 held in place, solids can be lifted that are in the fluid. The bristle 1028 can trap the solids and hold them away from the pump. This stops the solids from migrating into various areas of the pump assembly and prevents the solids from settling back into the area of the pump stator.

Upon pump startup, the bristle 1028 is stationary. During initial rod rotation or initial upward fluid movement in the assembly 1000, the moving fluid will contact the bristle 1028 and move through it, forcing the bristle 1028 to extend upward. As the fluid flows through the bristle 1028, the bristles 1028 will filter the solids as the solids become trapped in the bristle 1028. The moving fluid will also force the clutch system of the top brush retainer with clutch 1074 and sleeve with clutch 1012 to engage, with clutching surfaces 1076, projecting regions 1077, and recessed regions 1077A contacting and engaging clutching surfaces 1052, recessed regions 1053A and projecting regions 1053, respectively. Thus, with the clutch system, pump startup can occur with the bristle 1028 in a stationary state, until fluid forces the top brush retainer with clutch 1074 and sleeve with clutch 1012 to engage. As the bristle 1028 is forced upward, the set screw 1026 will ride in the slot 1031 or 1031A, with the piston 1024 moving in the direction of the top brush retainer with clutch 1074 (as shown in FIG. 45). As the piston 1024 moves in this manner, the bristle 1028 will begin to move through the volume of fluid and will partially extend. Thus, as this occurs, various components of the assembly 1000 can transition from their first orientation to a second orientation in which the bristle 1028 partially extends (see FIG. 45). The partially-extended bristle 1028 will allow for fluid passage. In one embodiment, when the set screw 1026 rides in slot 1031 (see FIGS. 38 and 43-46), the piston 1024 and bristle 1028 will move upward in a straight direction toward the top brush retainer with clutch 1074. In another embodiment, when the set screw 1026 rides in slot 1031A (see FIG. 39), the piston 1024 and bristle 1028 will rotate slightly while moving upward in a curved direction toward the top brush retainer with clutch 1074 as the set screw 1026 follows the curved path of the slot 1031A. The action of the bristle 1028 extending can leave the solids that it had collected behind high in the tubing away from the pump intake.

After initial rod rotation, the rods will continue to rotate and there will be dynamic upward fluid movement in the assembly 1000. During this dynamic upward fluid movement, the moving fluid will continue to contact the bristle 1028 and move through it, forcing the bristle 1028 further upward. As the fluid flows through the bristle 1028, the bristles 1028 will filter the solids as the solids become trapped in the bristle 1028. As the bristle 1028 is forced further upward, the set screw 1026 will continue to ride in the slot 1031 or 1031A, with the piston 1024 continuing to move in the direction of and eventually reaching the top brush retainer with clutch 1074 (as shown in FIG. 46). As the piston 1024 continues to move in this manner, the bristle 1028 will continue to move through the volume of fluid and will fully extend. Thus, as this occurs, various components of the assembly 1000 can transition from their second orientation to a third orientation in which the bristle 1028 fully extends (see FIG. 46). The fully-extended bristle 1028 will allow for further fluid passage. In one embodiment, when the set screw 1026 rides in slot 1031, the piston 1024 and bristle 1028 will continue to move upward in a straight direction toward and eventually reaching the top brush retainer with clutch 1074. In another embodiment, when the set screw 1026 rides in slot 1031A, the piston 1024 and bristle 1028 will rotate slightly while continuing to move upward in a curved direction toward and eventually reaching the top brush retainer with clutch 1074 as the set screw 1026 follows the path of the slot 1031A. The action of the bristle 1028 fully extending can further leave the solids that it had collected behind high in the tubing away from the pump intake.

After the pump rotor stops in the pump, the fluid in the well will begin to flow downward and will return to a static state. As this occurs, there will be downward fluid pressure on the bristle 1028, forcing it downward. This, in turn, will force the piston 1024 to move downward in the direction of the bottom brush retainer 1088 as the set screw 1026 rides in the slot 1031 or 1031A, thereby allowing the bristle 1028 to naturally collapse (as shown in FIG. 44). In one embodiment, when the set screw 1026 rides in slot 1031, the piston 1024 and bristle 1028 will move downward in a straight direction toward and eventually reaching the bottom brush retainer 1088. In another embodiment, when the set screw 1026 rides in slot 1031A, the piston 1024 and bristle 1028 will rotate slightly while moving downward in a curved direction toward and eventually reaching the bottom brush retainer 1088 as the set screw 1026 follows the path of the slot 1031A. When the pump rotor stops in the pump, there can be fluid back flow. The well fluid solids can concentrate just outside the pump intake and gradually become less concentrated further up the tubing.

With the brush tube 1022 permitted to float upon the rod 1086 as noted above, rod stacking or fluid restriction can be avoided since there is no resistance to the bristle 1028 or interference in the turning of the rod 1086. Further, the bristle 1028 is designed to be flexible in its helical arrangement and will be in a collapsed or retracted state upon starting the pump, with solids being held within the bristle 1028. This helps to prevent the rods from becoming over-torqued, which would result in well shutdown. When the bristle 1028 is fixed on the rotation of the rods, the rods can force the bristle 1028 through the fluid causing great resistance. This action can restrict the rods causing the rods to be forced in the tubing wall causing damage to both the rod and the tubing.

The design of the various embodiments described herein helps to prevent the drive rods in conventional rotational rod pump configurations from becoming over-torqued. When pumping operations have temporarily stopped, solids may settle and accumulate on the various components of the pump and assemblies 100, 700, 800, or 1000. For example, the top centralizer components (216, 718, 818, or 1018) and/or bottom centralizer components (218, 742, 842, or 1042) can become abridged with solids at this time. Accumulation of solids could potentially cause the top centralizer components (216, 718, 818, or 1018) and/or bottom centralizer components (218, 742, 842, or 1042) to seize. Since the top centralizer components (216, 718, 818, or 1018) and bottom centralizer components (218, 742, 842, or 1042) float in position within their respective assemblies, the drive rods are still permitted to rotate upon restarting of the pump, even if the top centralizer components (216, 718, 818, or 1018) and/or bottom centralizer components (218, 742, 842, or 1042) become stuck. As another example, the bristles (214, 728, 828, or 1028) as well can become abridged with solids when pumping operations have temporarily stopped. With respect to the assemblies 100, 800, and 1000 this can cause the floating brush tubes (204, 822, or 1022) to seize. Since the brush tubes (204, 822, or 1022) float in position within their respective assemblies, the drive rods are still permitted to rotate upon restarting of the pump, even if the brush tubes (204, 822, or 1022) become stuck.

Further, with respect to the assembly 100, upon restarting the pump after a pause in pumping operations, the top centralizer component 216 can break free from its friction connection to the end cap 208 and the bottom centralizer component 218 can break free from its friction connection to the end cap with clutch 206. This allows the rod 202 to rotate freely since the top centralizer component 216 and bottom centralizer component 218 are not permanently affixed to the end cap 208 and end cap with clutch 206, respectively. This also still permits the rod to rotate in the tubing, even when the tubing is filled with solids. This is because the rod 202 has no fulcrum effect to create resistance during rotation. Although there can be some resistance due to the inherent surface tension in the area of the rod, such resistance will not be sufficient to cause major torque concerns.

Further, with respect to the assembly 700, upon restarting the pump after a pause in pumping operations, the top centralizer component 718 and bottom centralizer component 742 can each break free from its friction connection to its corresponding shaft 710 and 738, respectively. This allows the rod to rotate freely since the top centralizer component 718 and bottom centralizer component 742 are not permanently affixed to their corresponding shafts 710 and 738, respectively. This also still permits the rod to rotate in the tubing, even when the tubing is filled with solids. As discussed above with respect to the assembly 100, this is because the rod has no fulcrum effect to create resistance during rotation. Although there can be some resistance due to the inherent surface tension in the area of the rod, such resistance will not be sufficient to cause major torque concerns.

Furthermore, with respect to the assembly 800, the magnetic connection between the top portion 802 and top brush retainer 874 and/or the magnetic connection between the bottom portion 806 and bottom brush retainer 888 provides certain advantages. In this regard, when the bristle 828 has become abridged with solids, the drive rod 886 can override the magnetic connection between these components, thereby allowing the pump to move fluid through the abridged areas and flush the solids away from the pump. Thereafter, the synchronizing magnets 871 on the brush retainers (874 and/or 888) can reconnect with the synchronizing magnets 870 on the sleeves (812 and/or 832), thereby allowing the brush tube 822 to catch up with the rpm of the drive rod 886. This helps to prevent these components of the assembly 800 from becoming damaged due to the constant rotation of the drive rod 886 during pumping operations. Further, upon restarting the pump after a pause in pumping operations, each centralizer component 818 and 842 can break free from its friction connection to the shaft 810 and 838, respectively, and the brush tube 822 can break free from its magnetic connection to the rod 886, allowing the rod 886 to rotate freely since the centralizer components 818 and 842 are not permanently affixed to the shafts 810 and 838, and the brush tube 822 is not permanently affixed to the rod 886. Further, since the centralizer components 818 and 842 are not permanently affixed to the shafts 810 and 838, and the brush tube 822 is not permanently affixed to the rod 886, the rod is still permitted to rotate in the tubing, even when the tubing is filled with solids. This is because the rod 886 has no fulcrum effect to create resistance during rotation. As discussed above with respect to the assemblies 100 and 700, with respect to the assembly 800 as well, although there can be some resistance due to the inherent surface tension in the area of the rod, such resistance will not be sufficient to cause major torque concerns.

Furthermore, with respect to the assembly 1000, upon restarting the pump after a pause in pumping operations, each centralizer component 1018 and 1042 can break free from its friction connection to the shaft 1010 and 1038, respectively. In addition, the clutch system of the top brush retainer with clutch 1074 and sleeve with clutch 1012 can disengage, allowing the brush tube 1022, in turn, to break free from its clutched connection to the rod 1086. This allows the rod 1086 to rotate freely since the centralizer components 1018 and 1042 are not permanently affixed to the shafts 1010 and 1038, and the brush tube 1022 is not permanently affixed to the rod 1086. Further, since the centralizer components 1018 and 1042 are not permanently affixed to the shafts 1010 and 1038, and the brush tube 1022 is not permanently affixed to the rod 1086, the rod is still permitted to rotate in the tubing, even when the tubing is filled with solids. This is because the rod 1086 has no fulcrum effect to create resistance during rotation. As discussed above with respect to the assemblies 100, 700, and 800, with respect to the assembly 1000 as well, although there can be some resistance due to the inherent surface tension in the area of the rod, such resistance will not be sufficient to cause major torque concerns.

The foregoing description is illustrative of particular embodiments of the invention, but is not meant to be a limitation upon the practice thereof. While embodiments of the disclosure have been described in terms of various specific embodiments, those skilled in the art will recognize that the embodiments of the disclosure may be practiced with modifications without departing from the spirit and scope of the invention.

What is claimed is:

1. A rod centralizer assembly comprising, in combination:
- a top portion, the top portion comprising:
  - a top centralizer component; and
  - a first sleeve having a first clutch;
- a bottom portion, the bottom portion comprising;
  - a bottom centralize component; and
  - a second sleeve; and
- a body portion positioned between the top portion and the bottom portion, the body portion comprising:
  - a brush tube;
  - a helical groove formed on the brush tube and spiraling vertically along a length of at least a lower portion of the brush tube;
  - a bristle coupled to the brush tube, wherein at least a portion of the bristle is positioned within the groove so that the bristle conforms to a spiral shape of the groove; and
- a clutch cover coupling positioned over a lower portion of the first sleeve.

2. The rod centralizer assembly of claim 1, wherein the top centralizer component includes a helical channel spiraling along a length of the top centralizer component and the bottom centralizer component includes a helical channel spiraling along a length of the bottom centralizer component.

3. The rod centralizer assembly of claim 1, further comprising:
- a top brush retainer having a second clutch, the top brush retainer interposed between the top portion and the body portion; and
- a bottom brush retainer interposed between the bottom portion and the body portion.

4. The rod centralizer assembly of claim 1, wherein the first sleeve includes a first plurality of clutching surfaces, the rod centralizer assembly further comprising:
- a top brush retainer having a second clutch, wherein the top brush retainer includes a second plurality of clutching surfaces;
- wherein the first plurality of clutching surfaces and the second plurality of clutching surfaces are configured to engage each other during t sward fluid movement.

5. A rod centralizer assembly comprising, in combination:
- a top portion, the top portion comprising a top centralizer component;
- a bottom portion, the bottom portion comprising a bottom centralizer component;
- a body portion positioned between the top portion and the bottom portion, the body portion comprising:
  - a brush tube;
  - a helical groove formed on the brush tube and spiraling vertically along a length of at least a lower portion of the brush tube; and
  - a bristle coupled to the brush tube, wherein at least a portion of the bristle is positioned within the groove so that the bristle conforms to a spiral shape of the groove; and
- a piston, wherein the piston is configured, to be slidably positioned over the brush tube; and
- wherein an upper portion of the bristle is coupled to the piston.

6. The rod centralizer assembly of claim 5, wherein the brush tube includes a slot extending along a length of the brush tube; and
- wherein the piston includes at least one set screw, wherein the at least one set screw is configured to be slidably positioned in the slot.

7. The rod centralizer assembly of claim 6, wherein the slot has a curved configuration.

8. The rod centralizer assembly of claim 5 wherein the bristle is configured to extend from a retracted position on a rod to an extended position on the rod and to retract from the extended position to the retracted position in order to cause solids entrained in fluid to become trapped in the bristle.

9. The rod centralizer assembly of claim 1, wherein the body portion is placed on one of a pump rod, hollow valve rod, and rotational rod.

10. A rod centralizer assembly comprising, in combination:
- a top portion, the top portion comprising:
  - a top centralizer component, wherein the top centralizer component includes a helical channel spiraling along a length of the top centralizer component; and
  - a first sleeve having a first clutch;
- a bottom portion, the bottom portion comprising:
  - a bottom centralizer component, wherein the bottom centralizer component includes a helical channel spiraling along a length of the bottom centralizer component; and
  - a second sleeve; and
- a body portion positioned between the top portion and the botto portion, the body portion comprising:
  - a brush tube, wherein the brush tube includes a slot extending along a length of the brush tube:
  - a helical groove formed on the brush tube and spiraling vertically along a length of at least a lower portion of the brush tube; and
  - a bristle coupled to the brush tube, wherein at least a portion of the bristle is positioned within the groove so that the bristle conforms to a spiral shape of the groove;

a top brush retainer having a second clutch, the top brush retainer interposed between the top portion and the body portion;

a piston, wherein the piston is configured to be slidably positioned over the brush tube and to receive an upper portion of the bristle, wherein the piston includes at least one set screw configured to be slidably positioned in the slot;

a bottom brush retainer interposed between the bottom portion and the body portion; and wherein the bristle is configured to extend from a retracted position on a rod to an extended position on the rod and to retract from the extended position to the retracted position in order to cause solids entrained in fluid to become trapped in the bristle.

11. The rod centralizer assembly of claim 10, further comprising a clutch cover coupling positioned over a lower portion of the first sleeve.

12. The rod centralizer assembly of claim 10 further comprising:

a first plurality of clutching surfaces formed on a lower end of the first sleeve; and a second plurality of clutching surfaces formed on an upper end of the top brush retainer;

wherein the first plurality of clutching surfaces and the second plurality of clutching surfaces are configured to engage each other during upward fluid movement.

13. The rod centralizer assembly of claim 10, wherein the slot has a curved configuration.

14. A method for removing solids from pumped fluid using an assembly comprising the steps of:

providing at least one rod centralizer assembly comprising, in combination:

a bottom portion, the top portion comprising a top centralizer component;

a bottom portion, the baton portion comprising a bottom centralizer componen and a body portion positioned between the top portion and the bottom portion, the body portion comprising:

a brush tube;

a helical groove formed on the brush tube and spiraling vertically along a length of at least a lower portion of the brush tube; and a bristle coupled to the brush tube, wherein at least a portion of the bristle is positioned within the groove so that the bristle conforms to a spiral shape of the groove;

utilizing the, at least one rod centralizer assembly. pumping fluid;

causing the fluid to flow upward through the bristle of the assembly;

causing the bristle to extend from a retracted position on a rod to an extended position on the rod by rotating the assembly about the rod from a first position to a second position; and causing solids entrained in the fluid to become trapped in the bristle.

15. The method of claim 14 wherein the rod centralizer assembly further comprises:

a top portion comprising a first sleeve having a first clutch, wherein the first sleeve includes a first plurality of clutching surfaces; and a top brush retainer having a second clutch, the ton brush retainer interposed between the top portion and the body portion, wherein the top brush retainer includes a second plurality of clutching surfaces;

wherein the first plurality of clutching surfaces and the second plurality of clutching surfaces are configured to engage each other during upward fluid movement.

16. The method of claim 14 wherein the rod centralizer assembly further comprises:

a piston, wherein the piston is configured to be slidably positioned over the brush tube; and wherein an upper portion of the bristle is coupled to the piston.

17. The method of claim 14, further comprising the step of attaching the rod centralizer assembly to a rod string.

18. The method of claim 17, further comprising the step of placing multiple rod centralizer assemblies proximate multiple joints of the rod string.

19. The method of claim 14, further comprising the steps of:

causing the fluid to flow downward through the bristle of the assembly;

causing the bristle to retract from the extended position on the rod to the retracted position on the rod by rotating the assembly about the rod from the second position to the first position; and causing solids entrained in the fluid to become trapped in the bristle.

* * * * *